US008965757B2

(12) United States Patent
Thyssen et al.

(10) Patent No.: US 8,965,757 B2
(45) **Date of Patent: *Feb. 24, 2015**

(54) SYSTEM AND METHOD FOR MULTI-CHANNEL NOISE SUPPRESSION BASED ON CLOSED-FORM SOLUTIONS AND ESTIMATION OF TIME-VARYING COMPLEX STATISTICS

(75) Inventors: Jes Thyssen, San Juan Capistrano, CA (US); Huaiyu Zeng, Red Bank, NJ (US); Juin-Hwey Chen, Irvine, CA (US); Nelson Sollenberger, Farmingdale, NJ (US); Xianxian Zhang, San Diego, CA (US)

(73) Assignee: Broadcom Corporation, Irvine, CA (US)

( * ) Notice: Subject to any disclaimer, the term of this patent is extended or adjusted under 35 U.S.C. 154(b) by 622 days.

This patent is subject to a terminal disclaimer.

(21) Appl. No.: 13/295,818

(22) Filed: Nov. 14, 2011

(65) Prior Publication Data

US 2012/0123772 A1 May 17, 2012

Related U.S. Application Data

(60) Provisional application No. 61/413,231, filed on Nov. 12, 2010.

(51) Int. Cl.
*G10L 21/02* (2013.01)
*G10L 21/0208* (2013.01)
(Continued)

(52) U.S. Cl.
CPC ..... *G10L 21/0208* (2013.01); *G10L 21/0272* (2013.01); *G10L 2021/02165* (2013.01); *H04R 1/245* (2013.01); *H04R 2410/07* (2013.01)
USPC ..... 704/226; 704/227; 704/228; 704/233; 381/94.1; 381/94.3; 381/94.7; 381/71.11; 379/406.08

(58) Field of Classification Search
CPC ..... G10L 2021/02165; G10L 21/0208; G10L 21/0272; G10L 25/78; G10L 2021/02085; G10L 2021/02162; G10L 25/90; G10L 21/0216; G10L 21/034; G10L 21/0364
USPC ..... 704/226–228, 233, 225, 203, 207; 381/94.3, 94.1, 94.2, 94.7, 71.11, 317, 381/321, 320; 379/406.08, 395
See application file for complete search history.

(56) References Cited

U.S. PATENT DOCUMENTS 4,570,746 A * 2/1986 Das et al. ..... 381/359
4,600,077 A * 7/1986 Drever ..... 181/242
(Continued)

*Primary Examiner* — Vijay B Chawan
(74) *Attorney, Agent, or Firm* — Sterne, Kessler, Goldstein & Fox P.L.L.C.

(57) ABSTRACT

Multi-channel noise suppression systems and methods are described that omit the traditional delay-and-sum fixed beamformer in devices that include a primary speech microphone and at least one noise reference microphone with the desired speech being in the near-field of the device. The multi-channel noise suppression systems and methods use a blocking matrix (BM) to remove desired speech in the input speech signal received by the noise reference microphone to get a "cleaner" background noise component. Then, an adaptive noise canceler (ANC) is used to remove the background noise in the input speech signal received by the primary speech microphone based on the "cleaner" background noise component to achieve noise suppression. The filters implemented by the BM and ANC are derived using closed-form solutions that require calculation of time-varying statistics of complex frequency domain signals in the noise suppression system.

20 Claims, 11 Drawing Sheets

(51) Int. Cl.

| | |
|---|---|
| ***G10L 21/0272*** | (2013.01) |
| ***H04R 1/24*** | (2006.01) |
| *G10L 21/0216* | (2013.01) |

(56) References Cited

U.S. PATENT DOCUMENTS

| | | | | |
|---|---|---|---|---|
| 5,288,955 | A * | 2/1994 | Staple et al. | 181/158 |
| 5,550,924 | A * | 8/1996 | Helf et al. | 381/94.3 |
| 5,574,824 | A * | 11/1996 | Slyh et al. | 704/226 |
| 5,757,937 | A * | 5/1998 | Itoh et al. | 381/94.3 |
| 5,943,429 | A * | 8/1999 | Handel | 381/94.2 |
| 6,230,123 | B1 * | 5/2001 | Mekuria et al. | 704/226 |
| 7,099,821 | B2 | 8/2006 | Visser et al. | |
| 7,359,504 | B1 * | 4/2008 | Reuss et al. | 379/406.02 |
| 7,464,029 | B2 * | 12/2008 | Visser et al. | 704/210 |
| 7,617,099 | B2 * | 11/2009 | Yang et al. | 704/228 |
| 7,916,882 | B2 | 3/2011 | Pedersen et al. | |
| 7,949,520 | B2 * | 5/2011 | Nongpiur et al. | 704/207 |
| 7,983,907 | B2 * | 7/2011 | Visser et al. | 704/227 |
| 8,150,682 | B2 * | 4/2012 | Nongpiur et al. | 704/207 |
| 8,340,309 | B2 * | 12/2012 | Burnett et al. | 381/71.6 |
| 8,374,358 | B2 | 2/2013 | Buck et al. | |
| 8,452,023 | B2 | 5/2013 | Petit et al. | |
| 8,515,097 | B2 * | 8/2013 | Nemer et al. | 381/94.1 |
| 2005/0036629 | A1 * | 2/2005 | Aubauer et al. | 381/71.1 |
| 2006/0193671 | A1 | 8/2006 | Yoshizawa et al. | |
| 2007/0021958 | A1 * | 1/2007 | Visser et al. | 704/226 |
| 2007/0030989 | A1 | 2/2007 | Kates | |
| 2007/0033029 | A1 | 2/2007 | Sakawaki | |
| 2008/0025527 | A1 * | 1/2008 | Haulick et al. | 381/93 |
| 2008/0033584 | A1 | 2/2008 | Zopf et al. | |
| 2008/0046248 | A1 | 2/2008 | Chen et al. | |
| 2008/0201138 | A1 * | 8/2008 | Visser et al. | 704/227 |
| 2010/0008519 | A1 | 1/2010 | Hayakawa et al. | |
| 2010/0223054 | A1 * | 9/2010 | Nemer et al. | 704/219 |
| 2010/0254541 | A1 | 10/2010 | Hayakawa | |
| 2010/0260346 | A1 | 10/2010 | Takano et al. | |
| 2011/0038489 | A1 | 2/2011 | Visser et al. | |
| 2011/0099007 | A1 | 4/2011 | Zhang | |
| 2011/0099010 | A1 | 4/2011 | Zhang | |
| 2011/0103626 | A1 | 5/2011 | Bisgaard et al. | |
| 2012/0010882 | A1 | 1/2012 | Thyssen et al. | |
| 2012/0121100 | A1 * | 5/2012 | Zhang et al. | 381/71.1 |
| 2012/0123771 | A1 * | 5/2012 | Chen et al. | 704/226 |
| 2012/0123773 | A1 | 5/2012 | Zeng et al. | |
| 2013/0044872 | A1 | 2/2013 | Eriksson et al. | |
| 2013/0211830 | A1 | 8/2013 | Petit et al. | |

* cited by examiner

400

600

SYSTEM AND METHOD FOR MULTI-CHANNEL NOISE SUPPRESSION BASED ON CLOSED-FORM SOLUTIONS AND ESTIMATION OF TIME-VARYING COMPLEX STATISTICS

CROSS REFERENCE TO RELATED APPLICATIONS

This application claims the benefit of U.S. Provisional Patent Application No. 61/413,231, filed on Nov. 12, 2010, which is incorporated herein by reference in its entirety.

FIELD OF THE INVENTION

This application relates generally to systems that process audio signals, such as speech signals, to remove undesired noise components therefrom.

BACKGROUND

The term noise suppression generally describes a signal processing technique that attempts to attenuate or remove an undesired noise component from an input signal. Noise suppression may be applied to almost any type of input signal that may include an undesired/interfering component such as a noise component. For example, noise suppression functionality is often implemented in telecommunications devices, such as telephones, Bluetooth® headsets, or the like, to attenuate or remove an undesired background noise component from an input speech signal. In general, an input speech signal may be viewed as comprising both a desired speech component (sometimes referred to as "clean speech") and a background noise component. Removing the background noise component from the input speech signal ideally leaves only the desired speech component as output.

In multi-microphone systems, noise suppression is often implemented based on the Generalized Sidelobe Canceler (GSC). The GSC consists of a fixed beamformer, a blocking matrix, and an adaptive noise canceler. In the most general case, the fixed beamformer functions to filter M input speech signals received from M microphones to create a so-called speech reference signal comprising a desired speech component and a background noise component. The blocking matrix creates M−1 background noise references by spatially suppressing the desired speech component in the M input speech signals. The adaptive noise canceler then estimates the background noise component in the speech reference signal, produced by the fixed beamformer based on the M−1 background noise references and suppresses the estimated background noise component from the speech reference signal, thereby ideally leaving only the desired speech component as output.

However, in some multi-microphone systems, at least one microphone is dedicated as a noise reference microphone and at least one microphone is dedicated as a primary speech microphone. The noise reference microphone is positioned to be relatively far from a desired speech source during regular use of the multi-microphone system. In fact, the noise reference microphone can be positioned to be as far from the desired speech source as possible during regular use of the multi-microphone system. Therefore, the input speech signal received by the noise reference microphone often will have a very poor signal-to-noise ratio (SNR). The primary speech microphone, on the other hand, is positioned to be relatively close to the desired speech source during regular use and, as a result, usually receives an input speech signal that has a much better SNR compared to the input speech signal received by the noise reference microphone.

In these multi-microphone systems, with a dedicated noise reference microphone and primary speech microphone, the traditional delay-and-sum fixed beamformer structure of the GSC (described above) may not make much sense because it can result in a speech reference signal with an SNR that is worse than that of the unprocessed input speech signal received by the primary speech microphone. In general, it is possible to get constructive interference between the desired speech components of input speech signals received by multiple microphones using the traditional delay-and-sum fixed beamformer structure. However, in the case of a multi-microphone system with a noise reference microphone and a primary speech microphone as described above, the traditional delay-and-sum fixed beamformer structure is often unable to improve the SNR compared to the primary speech microphone because of the poor SNR of the input speech signal received by the noise reference microphone. Thus, using the traditional delay-and-sum fixed beamformer structure in such a multi-microphone system often will result in a speech reference signal that has a worse SNR than that of the input speech signal received by the primary speech microphone.

Moreover, adaptive algorithms (e.g., a least mean square adaptive algorithm) conventionally used to derive the filters for the blocking matrix and the adaptive noise canceler of the GSC are often slow to converge.

Therefore, what is needed is an approach to multi-channel noise suppression that does not rely on the traditional delay-and-sum fixed beamformer structure of the GSC and/or slow to converge adaptive algorithms for deriving filters used to suppress noise.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 8:
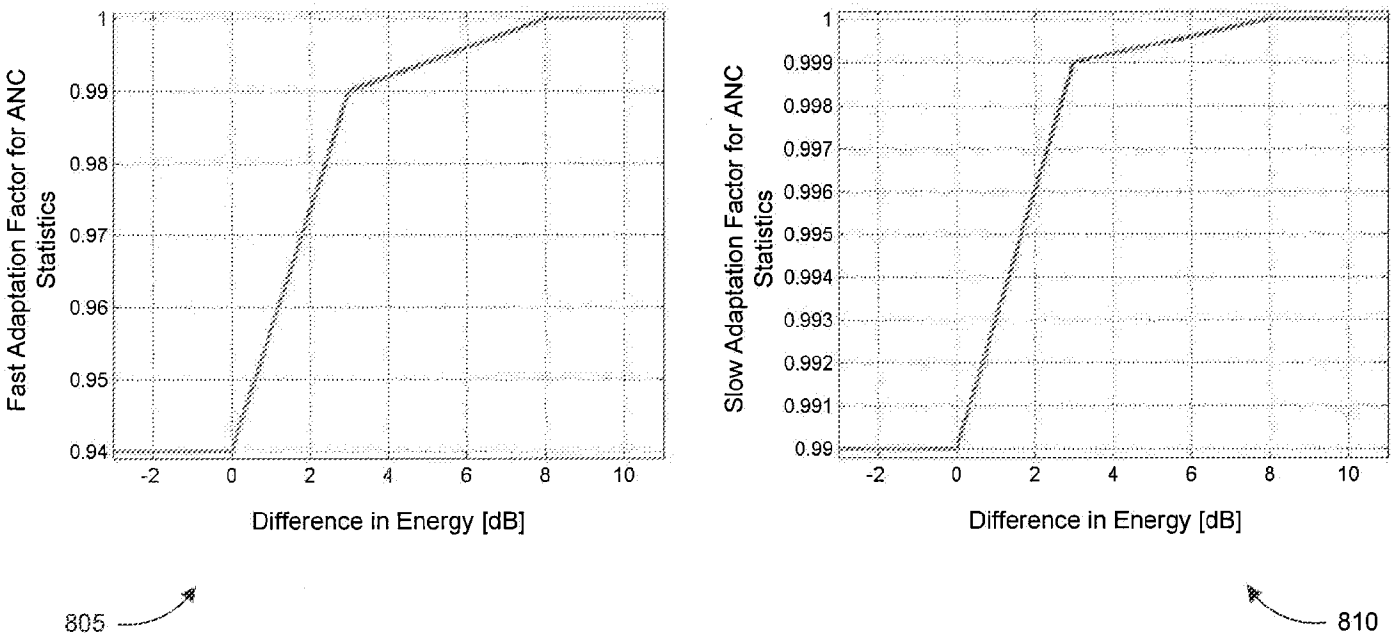
Figure 9:
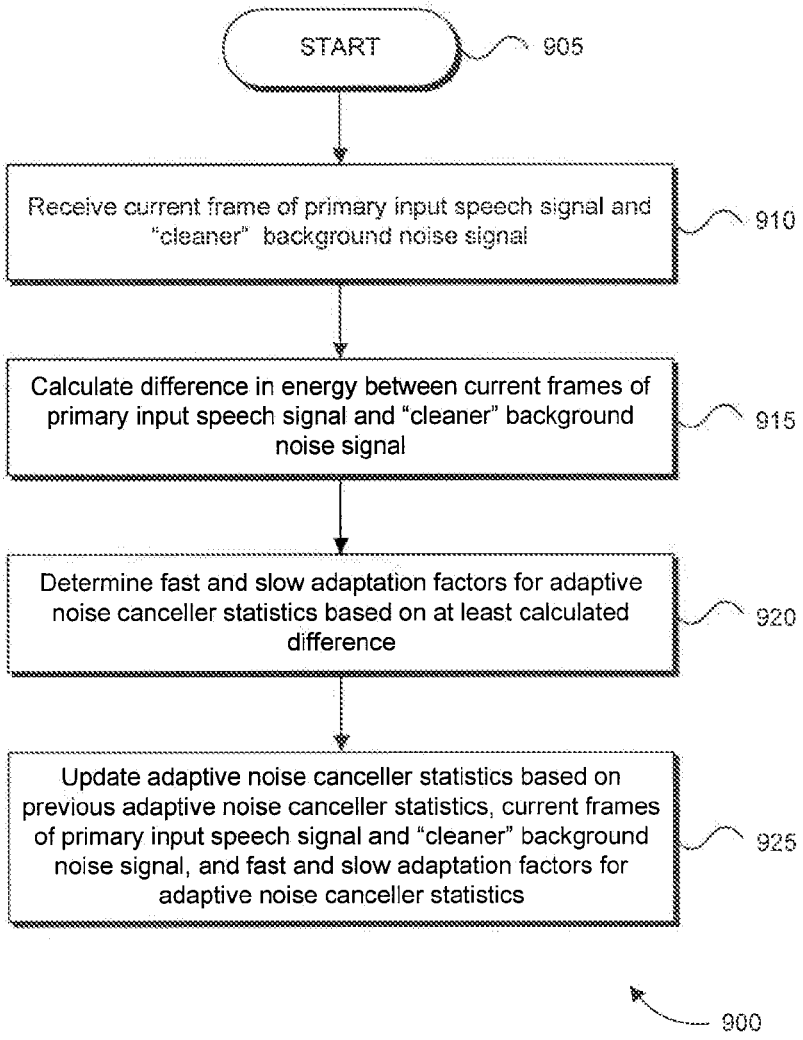

FIG. 8 illustrates example piecewise linear mappings from difference in energy (or moving average of difference in energy) between a primary input speech signal and a "cleaner" background noise component to adaptation factor for estimating time varying statistics for a closed form solution of an ANC section in accordance with an embodiment of the present invention FIG. 9 illustrates a flowchart of a method for estimating the time-varying statistics of an adaptive noise canceler filter in accordance with an embodiment of the present invention.

Figure 3:
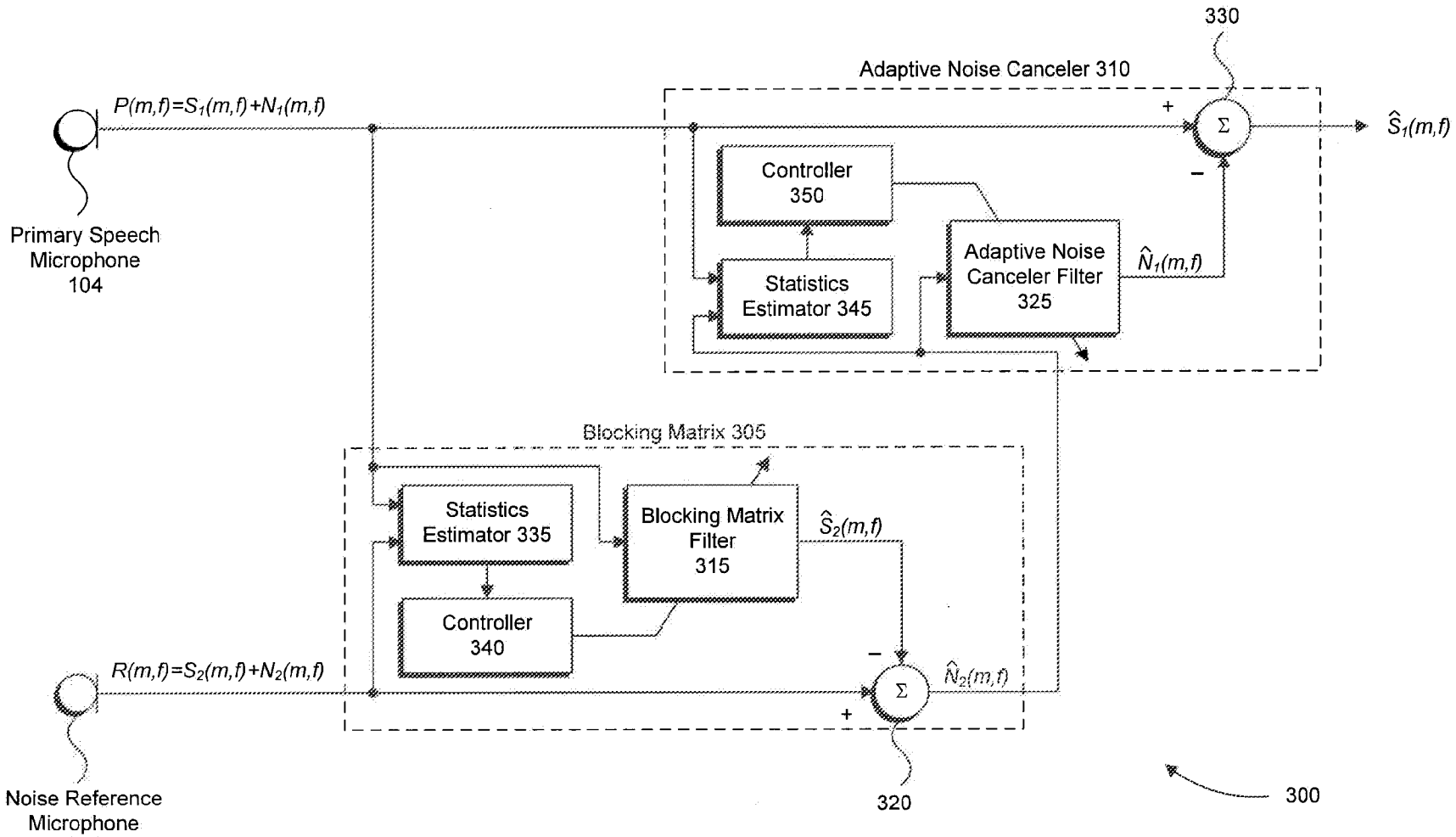
FIG. 3 illustrates a block diagram of an example system for multi-channel noise suppression in accordance with an embodiment of the present invention.
Figure 10:
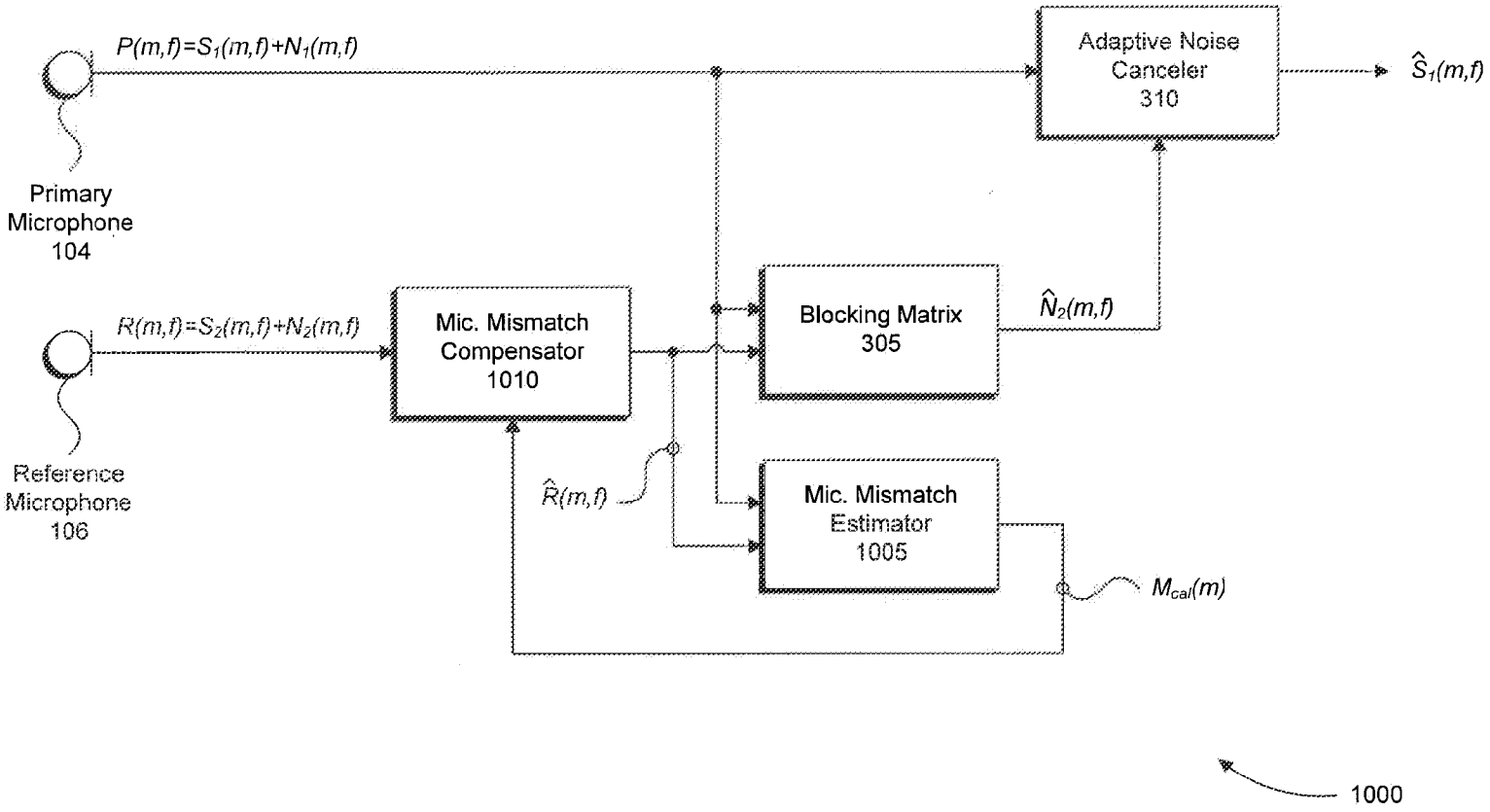
Figure 11:
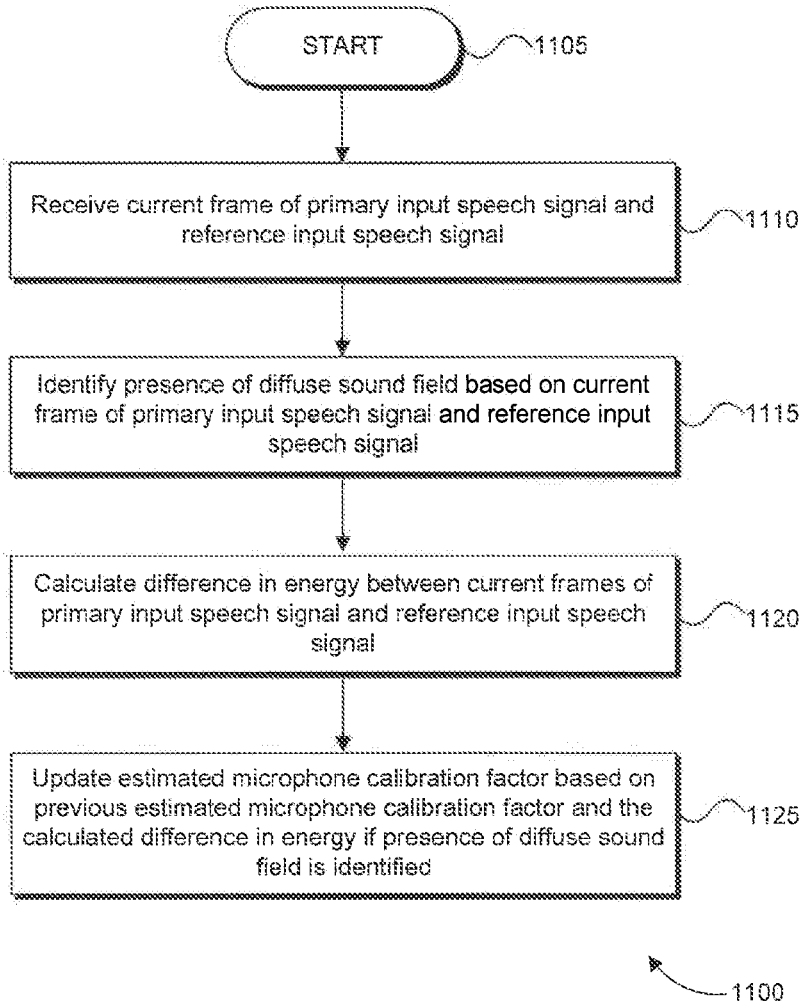

FIG. 10 illustrates an exemplary variation of the multi-channel noise suppression system of FIG. 3 that further implements an automatic microphone calibration scheme in accordance with an embodiment of the present invention FIG. 11 illustrates a flowchart of a method for updating a current estimated value of a microphone sensitivity mismatch in accordance with an embodiment of the present invention.

Figure 12:
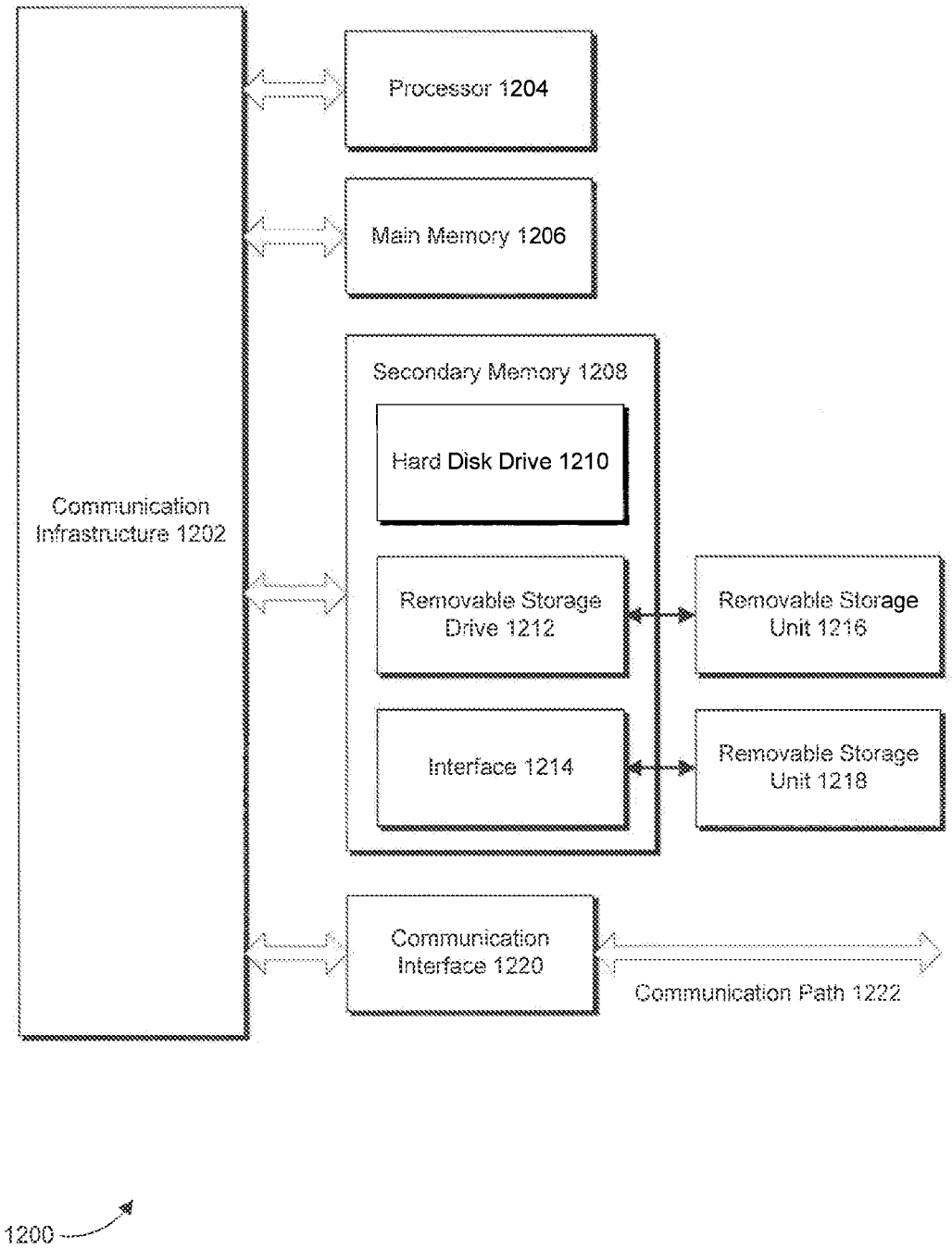

FIG. 12 illustrates a block diagram of an example computer system that can be used to implement aspects of the present invention.

The present invention will be described with reference to the accompanying drawings. The drawing in which an element first appears is typically indicated by the leftmost digit(s) in the corresponding reference number.

DETAILED DESCRIPTION

1. Introduction

In the following description, numerous specific details are set forth in order to provide a thorough understanding of the invention. However, it will be apparent to those skilled in the art that the invention, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring aspects of the invention.

References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

As noted in the background section above, certain multi-microphone systems include a primary speech microphone and a noise reference microphone. The primary speech microphone is positioned to be close to a desired speech source during regular use of the multi-microphone system, whereas the noise reference microphone is positioned to be farther from the desired speech source during regular use of the multi-microphone system. Therefore, the input speech signal received by the primary speech microphone typically will have a better SNR compared to the input speech signal received by the noise reference microphone. In these multi-microphone systems, if the SNR on the noise reference phone is much worse than the primary speech microphone then the use of a traditional delay-and-sum fixed beamformer structure to suppress background noise generally does not make much sense because it can result in a speech reference signal with an SNR that is worse than that of the unprocessed input speech signal received by the primary speech microphone.

The multi-channel noise suppression systems and methods described herein omit the traditional delay-and-sum fixed beamformer in devices that include a primary speech microphone and at least one noise reference microphone as noted above. The multi-channel noise suppression systems and methods use a blocking matrix (BM) to remove desired speech in the input speech signal received by the noise reference microphone to get a "cleaner" background noise component. Then, an adaptive noise canceler (ANC) is used to remove the background noise in the input speech signal received by the primary speech microphone based on the "cleaner" background noise component to achieve noise suppression.

In accordance with embodiments described herein, the filters implemented by the BM and ANC are derived using closed-form solutions that require calculation of time-varying statistics (for frequency domain implementations) of complex signals in the noise suppression system. Conventionally, adaptive algorithms that are potentially slow to converge have been used to derive such filters. Furthermore, in accordance with embodiments described herein, spatial information embedded in the input speech signals received by the primary speech microphone and the noise reference microphone is exploited to estimate the necessary time-varying statistics to perform closed-form calculations of the filters implemented by the BM and ANC.

It should be noted that, wherever a difference in energy between two signals is used to perform a function or determine a subsequent value as described below (where difference in energy can be calculated, for example, by subtracting the log-energy of the two signal), a difference in level between the two signals (i.e., difference in signal level) can be used instead.

2. System for Multi-Channel Noise Suppression

Figure 1:
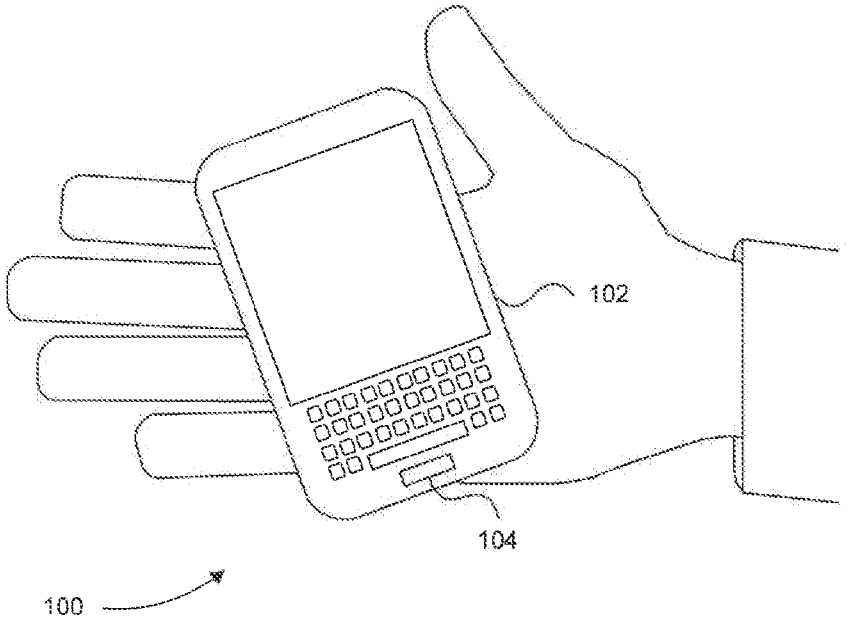
FIG. 1 illustrates a front view of an example wireless communication device in which embodiments of the preset invention can be implemented.
Figure 2:
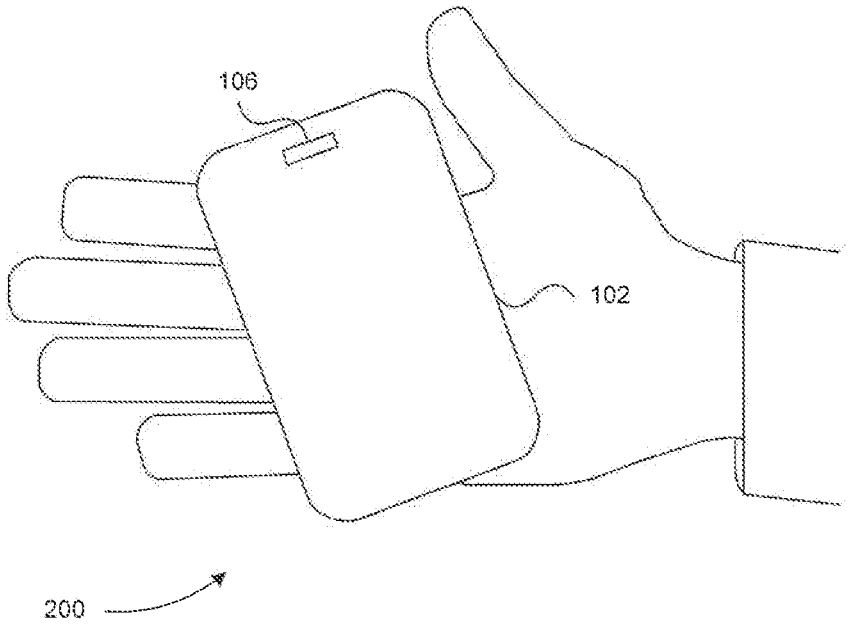
FIG. 2 illustrates a back view of the example wireless communication device shown in FIG. 1.

FIGS. 1 and 2 respectively illustrate a front portion 100 and a back portion 200 of an example wireless communication device 102 in which embodiments of the present invention can be implemented. Wireless communication device 102 can be a personal digital assistant (PDA), a cellular telephone, or a tablet computer, for example.

As shown in FIG. 1, front portion 100 of wireless communication device 102 includes a primary speech microphone 104 that is positioned to be close to a user's mouth during regular use of wireless communication device 102. Accordingly, primary speech microphone 104 is positioned to capture the user's speech (i.e., the desired speech). As shown in FIG. 2, a back portion 200 of wireless communication device 102 includes a noise reference microphone 106 that is positioned to be farther from the user's mouth during regular use than primary speech microphone 104. For instance, noise reference microphone 106 can be positioned as far from the user's mouth during regular use as possible.

Although the input speech signals received by primary speech microphone 104 and noise reference microphone 106 will each contain desired speech and background noise components, by positioning primary speech microphone 104 so that it is closer to the user's mouth than noise reference microphone 106 during regular use, the level of the user's speech that is captured by primary speech microphone 104 is likely to be greater than the level of the user's speech that is detected by noise reference microphone 106. This, along with the observation that noise sources which are further from the device will produce approximately similar levels on the two microphones, can be exploited to effectively estimate the necessary statistics to calculate filter coefficients for suppressing background noise as will be described further below in regard to FIG. 3.

It should be noted that primary speech microphone 104 and noise reference microphone 106 are shown to be positioned on the respective front and back portions of wireless communication device 102 for illustrative purposes only and is not intended to be limiting. Persons skilled in the relevant art(s) will recognize that primary speech microphone 104 and noise reference microphone 106 can be positioned in any suitable locations on wireless communication device 102.

It should be further noted that a single noise reference microphone 106 is shown in FIG. 2 for illustrative purposes only and is not intended to be limiting. Persons skilled in the relevant art(s) will recognize that wireless communication device 102 can include any reasonable number of reference microphones.

Moreover, primary speech microphone 104 and noise reference microphone 106 are respectively shown in FIGS. 1 and 2 to be included in wireless communication device 102 for illustrative purposes only. It will be recognized by persons skilled in the relevant art(s) that primary speech microphone 104 and noise reference microphone 106 can be implemented in any suitable multi-microphone system or device that operates to process audio signals for transmission, storage and/or playback to a user. For example, primary speech microphone 104 and noise reference microphone 106 can be implemented in a Bluetooth® headset, a hearing aid, a personal recorder, a video recorder, or a sound pick-up system for public speech.

Referring now to FIG. 3, a block-diagram of a multi-channel noise suppression system 300 that can be implemented in wireless communication device 102 is illustrated in accordance with an embodiment of the present invention. System 300 is configured to process a primary input speech signal P(m, f) received by primary speech microphone 104 and a reference input speech signal R(m, f) received by noise reference microphone 106 to attenuate or remove background noise from P(m, f). As noted above, both input speech signals P(m, f) and R(m, f), received by the two microphones, contain components of the user's speech (i.e., the desired speech) and background noise. More specifically, P(m, f) contains a desired speech component $S_1(m, f)$ and a background noise component $N_1(m, f)$, and R(m, f) contains a desired speech component $S_2(m, f)$ and a background noise component $N_2(m, f)$. However, because of the position of primary speech microphone 104 and noise reference microphone 106 on wireless communication device 102 relative to the expected position of the desired speech source, the level of the desired speech component $S_1(m, f)$ in P(m, f) is likely to be greater than the level of the desired speech component $S_2(m, f)$ in R(m, f). In addition, there will typically be little difference in level between the background noise components $N_1(m, f)$ and $N_2(m, f)$ of the two input speech signals because the relative distance between each microphone and a background noise source is expected to be about the same in most instances, or at the least far more similar than the than the relative distance between the desired speech source and the two microphones, respectively. Hence, the level difference for a desired speech source will be greater than the level difference for noise sources. This can be used to discriminate between desired and interfering (noise) sources. System 300 is configured to exploit this information to filter P(m, f) using R(m, f) to provide, as output, a noise suppressed primary input speech signal $\hat{S}_1(m, f)$.

As shown in FIG. 3, system 300 includes a blocking matrix (BM) 305 and an adaptive noise canceler (ANC) 310. BM 305 is configured to estimate and remove the desired speech component $S_2(m, f)$ in R(m, f) to produce a "cleaner" background noise component $N_2(m, f)$. More specifically, BM 305 includes a blocking matrix filter 315 configured to filter P(m, f) to provide an estimate of the desired speech component $S_2(m, f)$ in R(m, f). BM 305 then subtracts the estimated desired speech component $\hat{S}_2(m, f)$ from R(m, f) using subtractor 320 to provide, as output, the "cleaner" background noise component $\hat{N}_2(m, f)$.

After $\hat{N}_2(m, f)$ has been obtained, ANC 310 is configured to estimate and remove the undesirable background noise component $N_1(m, f)$ in P(m, f) to provide, as output, the noise suppressed primary input speech signal $\hat{S}_1(m, f)$. More specifically, ANC 310 includes an adaptive noise canceler filter 325 configured to filter the "cleaner" background noise component $N_2(m, f)$ to provide an estimate of the background noise component $N_1(m, f)$ in P(m, f). ANC 310 then subtracts the estimated background noise component $\hat{N}_1(m, f)$ from P(m, f) using subtractor 330 to provide, as output, the noise suppressed primary input speech signal $\hat{S}_1(in, f)$.

In an embodiment, and as illustrated in FIG. 3, the primary input speech signal P(m, f) and the reference input speech signal R(m, f) are represented and processed in the frequency domain, on a frame-by-frame basis, by BM 305 and ANC 310, where m indexes the time or a particular frame made up of consecutive time domain samples of the input speech signal and f indexes a particular frequency component or sub-band of the input speech signal. Thus, for example, P(1,10) denotes the complex value of the $10^{th}$ frequency component or sub-band for the $1^{st}$ time index or frame of the primary input speech signal P(m, f). The same representation is true, in at least one embodiment, for other signals and signal components illustrated in FIG. 3. It should be noted that in other embodiments the primary input speech signal P(m, f) and the reference input speech signal R(m, f) can be represented and processed in the time domain on a frame-by-frame basis.

Although system 300 is described above as being implemented in wireless communication device 102 illustrated in FIG. 1, system 300 can be implemented in any suitable multi-microphone system or device that operates to process audio signals for transmission, storage and/or playback to a user. For example, system 300 can be implemented in a Bluetooth® headset, a hearing aid, a personal recorder, a video recorder, or a sound pick-up system for public speech. System 300 can be implemented in hardware using analog and/or digital circuits, in software, through the execution of instructions by one or more general purpose or special-purpose processors, or as a combination of hardware and software.

In the sub-sections that follow, exemplary derivations of closed form solutions for a frequency domain blocking matrix filter 315 and a hybrid approach blocking matrix filter 315 are described. In addition, in the following sub-sections that follow, exemplary derivations of closed form solutions for a frequency domain adaptive noise canceler filter 325 and a hybrid approach adaptive noise canceler filter 325 are described.

2.1 The Blocking Matrix

As noted above, BM 305 includes a blocking matrix filter 315 configured to filter the primary input speech signal P(m, f) to provide an estimate of the desired speech component $S_2(m, f)$ in the reference input speech signal R(m, f). BM 305 then subtracts the estimated desired speech component $\hat{S}_2(m, f)$ from R(m, f) using subtractor 320 to provide the "cleaner" background noise component $\hat{N}_2(m, f)$.

Ideally, no residual amount of the desired speech component $S_2(m, f)$ is left in the "cleaner" background noise component $\hat{N}_2(m, f)$. However, because of the time-varying nature of the signals processed by BM 305 and the inability of the blocking matrix filter to perfectly model the acoustic channel for the desired speech between the two microphones, often some residual amount of the desired speech component $S_2(m, f)$ will be left in the "cleaner" background noise component $\hat{N}_2(m, f)$. This residual amount of the desired speech component $S_2(m, f)$ can be observed at the output of BM 305 (i.e., based on $\hat{N}_2(m, f)$) during periods of time (or frames) when mostly desired speech, and little or no background noise, makes up the primary input speech signal P(m, f). If BM 305 is functioning well, the output of BM 305, $\hat{N}_2(m, f)$, should be nearly zero during these periods of time (or frames). The residual amount of desired speech component $S_2(m, f)$ can be simply expressed as:

$$\begin{aligned}\hat{N}_2(m, f) &= R(m, f) - \hat{S}_2(m, f) \\ &= R(m, f) - H(f)P(m, f)\end{aligned} \tag{1}$$

where H(f) is the transfer function of blocking matrix filter 315, m indexes the time or frame, and f indexes a particular frequency component or sub-band.

To achieve the objective of removing the desired speech component $S_2$ (m, f) in the reference input speech signal R(m, f), the transfer function H(f) of blocking matrix filter 315 can be derived (or updated) to substantially minimize the power of the residual signal expressed in Eq. (1) during periods of time (or frames) when the primary input speech signal P(m, f) is predominantly equal to the desired speech signal $\hat{S}_1(m, f)$. The power of the residual signal, also referred to as a cost function, can be expressed as:

$$E_{\hat{N}_2} = \sum_m \sum_f \hat{N}_2(m, f)\hat{N}_2^*(m, f) \tag{2}$$

where ( )* indicates complex conjugate.

In the following sub-sections, a frequency domain blocking matrix filter 315 and a hybrid approach blocking matrix filter 315 are derived (or updated) based on this cost function.

2.1.1 Example Derivation of Frequency Domain Blocking Matrix Filter

The frequency domain blocking matrix filter 315 is derived (or updated) based on a closed form solution below assuming a single complex tap per frequency bin. However, persons skilled in the relevant art(s) will recognize based on the teachings herein that the proposed solution can be generalized to multiple taps per bin.

The cost function expressed in Eq. (2) is expanded as:

$$\begin{aligned}E_{\hat{N}_2} &= \sum_m \sum_f \hat{N}_2(m, f)\hat{N}_2^*(m, f) \\ &= \sum_f \sum_m (R(m, f) - H(f)P(m, f))(R(m, f) - H(f)P(m, f))^* \\ &= \sum_f \sum_m R(m, f)R^*(m, f) - H(f)\sum_m P(m, f)R^*(m, f) - \\ &\quad H^*(f)\sum_m R(m, f)P^*(m, f) \\ &= \sum_f C_{R,R^*}(f) - H(f)C_{P,R^*}(f) - H^*(f)C_{R,P^*}(f) + \\ &\quad H(f)H^*(f)C_{P,P^*}(f)\end{aligned} \tag{3}$$

The gradient of $E_{\hat{N}_2}$ with respect to H(f) is calculated from:

$$\nabla_H\left(E_{\hat{N}_2}\right) = \frac{\partial E_{\hat{N}_2}}{\partial \mathrm{Re}\{H(f)\}} + j\frac{\partial E_{\hat{N}_2}}{\partial \mathrm{Im}\{H(f)\}} \tag{4}$$

by inserting:

$$\frac{\partial E_{\hat{N}_2}}{\partial \mathrm{Re}\{H(f)\}} = -C_{P,R^*}(f) - C_{R,P^*}(f) + H(f)C_{P,P^*}(f) + H^*(f)C_{P,P^*}(f) \tag{5}$$

$$\frac{\partial E_{\hat{N}_2}}{\partial \mathrm{Im}\{H(f)\}} = -jC_{P,R^*}(f) + jC_{R,P^*}(f) + jH^*(f)C_{P,P^*}(f) - jH(f)C_{P,P^*}(f) \tag{6}$$

resulting in:

$$\begin{aligned}\nabla_H\left(E_{\hat{N}_2}\right) &= -2C_{R,P^*}(f) + 2H(f)C_{P,P^*}(f) \\ &= 0 \\ &\Downarrow \\ H(f) &= \frac{C_{R,P^*}(f)}{C_{P,P^*}(f)}\end{aligned} \tag{7}$$

where $C_{R,P^*}(f)$ and $C_{P,P^*}(f)$ represent time-varying statistics derived (or updated) during periods of time (or frames) when the input speech signal P(m, f) is predominantly equal to the desired speech signal $S_1(m, f)$. This can be quantified by the energy of the desired speech signal being greater than the energy of the background by a significant degree. The statistics can be expressed as:

$$C_{R,P^*}(f) = \sum_m R(m, f)P^*(m, f) \tag{8}$$

$$C_{P,P^*}(f) = \sum_m P(m, f)P^*(m, f) \tag{9}$$

The condition that these statistics be derived (or updated) when the energy of the desired speech is greater than the energy of the background noise in primary input speech signal P(m, f) by a large degree means that reference input speech signal R(m, f) and primary input speech signal P(m, f) generally are dominated by desired speech, ideally only include desired speech. Thus, the calculation of $C_{R,P^*}(f)$ as the sum of products of the reference input speech signal R(m, f) and the complex conjugate primary input speech signal P(m, f) at a given frequency bin f for some number of frames can be seen as a way of estimating the cross-spectrum at that frequency bin between the desired speech component in the reference input speech signal R(m, f) and the desired speech component in the primary input speech signal P(m, f). Consequently, $C_{R,P^*}(f)$ can be referred to as the cross-channel statistics of the desired speech, or just desired speech cross-channel statistics.

Similarly, the calculation of $C_{P,P^*}(f)$ as the sum of products of the primary input speech signal P(m, f) and its own complex conjugate at a given frequency bin f for some number of frames can be seen as a way of estimating the power spectrum at that frequency bin of the desired speech component in the primary input speech signal P(m, f). Consequently, $C_{P,P^*}(f)$ can be referred to as the desired speech statistics of the primary input speech signal.

Collectively, the cross-channel statistics of the desired speech and the desired speech statistics of the primary input speech signal can be referred to as simply the desired speech statistics. Further details and variants on the method of calculating the desired speech statistics are provided below in section 3.

In the embodiment where blocking matrix filter 315 is implemented in the frequency domain by multiplication, statistics estimator 335, illustrated in FIG. 3, is configured to derive (or update) estimates of the statistics $C_{R,P^*}(f)$ and $C_{P,P^*}(f)$ and provide the estimates to controller 340, also illustrated in FIG. 3. Controller 340 is then configured to use the estimates of the statistics $C_{R,P^*}(f)$ and $C_{P,P^*}(f)$ to configure blocking matrix filter 315. For example, controller 340 can use these values to configure blocking matrix filter 315 in accordance with the transfer function H(f) expressed in Eq. (7), although this is only one example.

2.1.2 Example Derivation of Hybrid Approach Blocking Matrix Filter

A hybrid variation of blocking matrix filter 315 in accordance with an embodiment of the present invention will now be described. The hybrid variation combines the frequency domain approach described above with a time domain approach. This can be a practical solution to performing noise suppression within a sub-band based audio system where an increased frequency resolution is desirable for the noise suppressor. The limited frequency resolution is expanded by applying a low-order time domain solution to individual frequency bins or sub-bands. This also offers the possibility of expanding the frequency resolution based on a psycho-acoustically motivated frequency resolution, e.g., expand low frequency regions more than high frequency regions. As a practical example, one may have a sub-band decomposition with 32 complex sub-bands in 0 to 4 kHz. This provides a spectral resolution of 125 Hz which may be inadequate. Instead of expanding the spectral resolution of all sub-bands to 32 Hz by a $4^{th}$ order noise suppression filter, it may be desirable to expand the low sub-bands by 4, the middle sub-bands by 2, and leave the upper sub-bands at the native resolution.

The hybrid approach changes the "filtering" with the transfer function H(f) from:

$$\hat{S}_2(m,f)=H(f)P(m,f) \tag{10}$$

to:

$$\hat{S}_2(m,f)=\sum_{k=0}^{K}H(k,f)P(m-k,f) \tag{11}$$

where m indexes the time or frame, f indexes a particular sub-band, and k=0, 1 . . . K indexes the individual filter coefficients for a particular frequency index f, making up the noise suppression time direction filter in that particular frequency bin. Hence, the term time direction filter can be used to refer to the individual noise suppression filters that filter the frequency bins, or sub-band signals, of the primary input speech signal P(m, f) in the time direction.

The residual signal in Eq. (1) can be rewritten based on Eq. (11) as follows:

$$\hat{N}_2(m,f)=R(m,f)-\sum_{k=0}^{K}H(k,f)P(m-k,f) \tag{12}$$

Substituting Eq. (12) into Eq. (2), the gradient of $E_{\hat{N}_2}$ with respect to H(k, f) is calculated as:

$$\begin{aligned}
\nabla_{H(k,f)}(E_{\hat{N}_2}) &= \frac{\partial E_{\hat{N}_2}}{\partial \mathrm{Re}\{H(k,f)\}}+j\frac{\partial E_{\hat{N}_2}}{\partial \mathrm{Im}\{H(k,f)\}} \\
&= \sum_m \hat{N}_2^*(m,f)\frac{\partial \hat{N}_2(m,f)}{\partial \mathrm{Re}\{H(k,f)\}}+ \\
&\quad \hat{N}_2(m,f)\frac{\partial \hat{N}_2^*(m,f)}{\partial \mathrm{Re}\{H(k,f)\}}+j\sum_m N_2^*(m,f) \\
&\quad \frac{\partial \hat{N}_2(m,f)}{\partial \mathrm{Im}\{H(k,f)\}}+\hat{N}_2(m,f)\frac{\partial \hat{N}_2^*(m,f)}{\partial \mathrm{Im}\{H(k,f)\}} \\
&= \sum_m -\hat{N}_2^*(m,f)P(m-k,f)-\hat{N}_2(m,f) \\
&\quad P^*(m-k,f)+j\sum_m -\hat{N}_2^*(m,f)jP(m-k,f)+ \\
&\quad \hat{N}_2(m,f)jP^*(m-k,f) \\
&= -2\sum_m N_2(m,f)P^*(m-k,f) \\
&= -2\sum_m\left(R(m,f)-\sum_{l=0}^{K}H(l,f)P(m-l,f)\right) \\
&\quad P^*(m-k,f) \\
&= 2\sum_{l=0}^{K}H(l,f)\left(\sum_m P(m-l,f)P^*(m-k,f)\right) \\
&\quad 2\left(\sum_m R(m,f)P^*(m-k,f)\right) \\
&= 0
\end{aligned} \tag{13}$$

The set of K+1 equations (for k=0, 1, . . . K) of Eq. (13) provides a matrix equation for every frequency bin f to solve for H(k, f), where k=0, 1, . . . K:

$$\begin{bmatrix}
\sum_m P(m,f)P^*(m,f) & \sum_m P(m-1)P^*(m,f) & \cdots & \sum_m P(m-K,f)P^*(m,f) \\
\sum_m P(m,f)P^*(m-1,f) & \sum_m P(m-1,f)P^*(m-1,f) & \cdots & \sum_m P(m-K,f)P^*(m-1,f) \\
\vdots & \vdots & \ddots & \vdots \\
\sum_m P(m,f)P^*(m-K,f) & \sum_m P(m-1,f)P^*(m-K,f) & \cdots & \sum_m P(m-K,f)P^*(m-K,f)
\end{bmatrix}
\begin{bmatrix} H(0,f) \\ H(1,f) \\ \vdots \\ H(K,f) \end{bmatrix}
=
\begin{bmatrix}
\sum_m R(m,f)P^*(m,f) \\
\sum_m R(m,f)P^*(m-1,f) \\
\vdots \\
\sum_m R(m,f)P^*(m-K,f)
\end{bmatrix} \tag{14}$$

This solution can be written as:

$$\underline{R}_P(f)\cdot\underline{H}_2(f)=\underline{r}_{R,P^*}(f) \tag{15}$$

where:

$$\underline{R}_P(f)=\sum_m \underline{P}^*(m,f)\cdot\underline{P}(m,f)^T \tag{16}$$

$$\underline{r}_{R,P^*}(f)=\sum_m R(m,f)\cdot\underline{P}^*(m,f) \tag{17}$$

$$\underline{P}(m,f)=\begin{bmatrix}P(m,f)\\P(m-1,f)\\\vdots\\P(m-K,f)\end{bmatrix},\ \underline{H}(f)=\begin{bmatrix}H(0,f)\\H(1,f)\\\vdots\\H(K,f)\end{bmatrix} \tag{18}$$

and the superscript T denotes non-conjugate transpose. The solution per frequency bin to the time direction filter is thus given by:

$$\underline{H}(f)=(\underline{R}_P(f))^{-}\cdot\underline{r}_{R,P^*}(f) \tag{19}$$

This solution appears to require a matrix inversion, but in most practical applications a matrix inversion is not needed.

In the embodiment where blocking matrix filter 315 is implemented based on the hybrid approach, statistics estimator 335 is configured to derive (or update) estimates of the statistics expressed in Eq. (16) and Eq. (17) and provide the estimates to controller 340. Controller 340 is then configured to use the estimates of the statistics to configure blocking matrix filter 315. For example, controller 340 can use these values to configure blocking matrix filter 315 in accordance with the transfer function H(f) expressed in Eq. (19), although this is only one example.

Comparing Eq. (16) and Eq. (17) to Eq. (9) and Eq. (8), respectively, it can be seen that the similar statistics are calculated by each set of equations, except that instead of calculating statistics only between current frequency bin components of signals, the hybrid solution requires calculation of statistics between vectors of current and past frequency bin components of signals, i.e. a time dimension is now part of the statistics. At the extreme, with no Discrete Fourier Transform (DFT), i.e. a single full band signal (the time domain signal), the hybrid method becomes a pure time domain method, and hence, the solution above provides the solution also for a pure time domain approach. The frequency index would become obsolete (as there is only one frequency band), and the signal vectors in the time direction would contain the signal time domain samples. A farther simplification in that case is that the time domain signal without DFT is real and not complex as in the case of the DFT bins or if a complex sub-band analysis has been applied.

2.1.3 Alternative Approach to Blocking Matrix

As discussed above, to achieve the objective of removing the desired speech component $S_2(m, f)$ in the reference input speech signal R(m, f), the transfer function H(f) of blocking matrix filter 315 can be derived (or updated) to substantially minimize the power of the residual signal, also referred to as a cost function, expressed in Eq. (2) during periods of time (or frames) when the primary input speech signal P(m, f) is predominantly desired speech.

As an alternative method to achieve the objective of removing the desired speech component $S_2(m, f)$ in the reference input speech signal R(m, f), the transfer function H(f) of blocking matrix filter 315 can be derived (or updated) to substantially minimize the power of the difference between the background noise component $N_2(m, f)$ in the reference input speech signal R(m, f) and the output of BM 305, $\hat{N}_2(m, f)$. The power of the difference between the background noise component $N_2(m,f)$ and the output of BM 305, $\hat{N}_2(m, f)$, can be expressed as:

$$E_{\hat{N}_2}=\sum_m\sum_f\left(N_2(m,f)-\hat{N}_2(m,f)\right)\left(N_2(m,f)-\hat{N}_2(m,f)\right)^* \tag{20}$$

where ( )* indicates complex conjugate.

Accommodating the hybrid approach, from Eq. (20) the gradient of $E_{\hat{N}_2}$ with respect to H(k, f) is calculated as:

$$\begin{aligned}
\nabla_{H(k,f)}\left(E_{\hat{N}_2}\right)&=\frac{\partial E_{\hat{N}_2}}{\partial\mathrm{Re}\{H(k,f)\}}+j\frac{\partial E_{\hat{N}_2}}{\partial\mathrm{Im}\{H(k,f)\}}\\
&=\sum_m\begin{pmatrix}\left(N_2(m,f)-\hat{N}_2(m,f)\right)^*\\ \frac{\partial\left(N_2(m,f)-\hat{N}_2(m,f)\right)}{\partial\mathrm{Re}\{H(k,f)\}}+\\ \left(N_2(m,f)-\hat{N}_2(m,f)\right)\\ \frac{\partial\left(N_2(m,f)-\hat{N}_2(m,f)\right)^*}{\partial\mathrm{Re}\{H(k,f)\}}\end{pmatrix}+\\
&\quad j\sum_m\begin{pmatrix}\left(N_2(m,f)-\hat{N}_2(m,f)\right)^*\\ \frac{\partial\left(N_2(m,f)-\hat{N}_2(m,f)\right)}{\partial\mathrm{Im}\{H(k,f)\}}+\\ \left(N_2(m,f)-\hat{N}_2(m,f)\right)\\ \frac{\partial\left(N_2(m,f)-\hat{N}_2(m,f)\right)^*}{\partial\mathrm{Im}\{H(k,f)\}}\end{pmatrix}\\
&=-\sum_m\left(N_2(m,f)-\hat{N}_2(m,f)\right)^*\frac{\partial\hat{N}_2(m,f)}{\partial\mathrm{Re}\{H(k,f)\}}+\\
&\quad\left(N_2(m,f)-\hat{N}_2(m,f)\right)\frac{\partial\hat{N}_2^*(m,f)}{\partial\mathrm{Re}\{H(k,f)\}}-\\
&\quad j\sum_m\left(N_2(m,f)-\hat{N}_2(m,f)\right)^*\frac{\partial\hat{N}_2(m,f)}{\partial\mathrm{Im}\{H(k,f)\}}+\\
&\quad\left(N_2(m,f)-\hat{N}_2(m,f)\right)\frac{\partial\hat{N}_2^*(m,f)}{\partial\mathrm{Im}\{H(k,f)\}}\\
&=\sum_m\left(N_2(m,f)-\hat{N}_2(m,f)\right)^*P(m-k,f)+\\
&\quad\left(N_2(m,f)-\hat{N}_2(m,f)\right)P^*(m-k,f)+\\
&\quad j\sum_m\left(N_2(m,f)-\hat{N}_2(m,f)\right)^*jP(m-k,f)-\\
&\quad\left(N_2(m,f)-\hat{N}_2(m,f)\right)jP^*(m-k,f)\\
&=2\sum_m\left(N_2(m,f)-\hat{N}_2(m,f)\right)P^*(m-k,f)\\
&=2\sum_m\begin{pmatrix}N_2(m,f)-R(m,f)+\\ \sum_{l=0}^{K}H(l,f)P(m-l,f)\end{pmatrix}P^*(m-k,f)\\
&=2\sum_{l=0}^{K}H(l,f)\left(\sum_m P(m-l,f)P^*(m-k,f)\right)-\\
&\quad 2\left(\sum_m R(m,f)P^*(m-k,f)\right)+
\end{aligned} \tag{21}$$

-continued $$2\left(\sum_m N_2(m, f)P^*(m-k, f)\right) = 0$$

Using the definitions of sub-section 2.1.2, the solution is given by the following matrix equation:

$$\underline{R}_P(f)\cdot\underline{H}(f) = \underline{r}_{R,P^*}(f) - \underline{r}_{N_2,P^*}(f) \quad (22)$$

$$\Updownarrow$$

$$\underline{H}(f) = \left(\underline{R}_P(f)\right)^{-1}\cdot\left(\underline{r}_{R,P^*}(f) - \underline{r}_{N_2,P^*}(f)\right)$$

In practice, the estimation of $\underline{r}_{N_2,P^*}(f)$ can be carried out based on a (reasonable) assumption of desired speech and background noise being independent:

$$\begin{aligned} r_{N_2,P^*}(k, f) &= \sum_m N_2(m, f)P^*(m-k, f) \quad (23)\\ &= \sum_m N_2(m, f)(S_1^*(m-k, f) + N_1^*(m-k, f))\\ &\approx \sum_m N_2(m, f)N_1^*(m-k, f)\\ &= r_{N_2,N_1^*}(k, f) \end{aligned}$$

Hence, Eq. (22) can be simplified to:

$$\underline{H}(f)=(\underline{R}_P(f))^{-1}\cdot(\underline{r}_{R,P^*}(f)-\underline{r}_{N_2,N_1^*}(f)) \quad (24)$$

Eq. (24) facilitates updating blocking matrix 315 when background noise is present in the environment of primary speech microphone 104 and noise reference microphone 106. This can be beneficial because most environmental background noise is not intermittent like speech, and hence it can be impractical to locate segments of primarily desired speech in primary input speech signal P(m, f) and reference input speech signal R(m, f) for updating the statistics required by the closed-form solution for the blocking matrix 315. The statistics $\underline{r}_{N_2,N_1}(f)$ can be estimated during desired speech absence. From examination of Eq. (24), it is immediately evident that $\underline{H}(f)$ of Eq. (24) converges to $\underline{0}$ during desired speech absence and clean-speech-$\underline{H}(f)$ (Eq. (19)) during background noise absence.

From Eq. (24), the solution according to the alternative approach for a single complex tap, K=0, is easily written as:

$$H(f) = \frac{r_{R,P^*}(f) - r_{N_2,N_1^*}(f)}{R_P(f)} \quad (25)$$

or, according to the notation of sub-section 2.1.1, as:

$$H(f) = \frac{C_{R,P^*}(f) - C_{N_2,N_1^*}(f)}{C_{P,P^*}(f)} \quad (26)$$

In this alternative embodiment, statistics estimator 335 is configured to obtain (or update) estimates of the statistics used in the calculations of Eq. (25) and/or Eq. (26) and provide the estimates to controller 340. Controller 340 is then configured to use the estimates to configure blocking matrix filter 315. For example, controller 340 can use these values to configure blocking matrix filter 315 in accordance with the transfer function H(f) expressed in Eq. (25) or (26).

2.2 The Adaptive Noise Canceler

As noted above, ANC 310 includes an adaptive noise canceler filter 325 configured to filter the "cleaner" background noise component $\hat{N}_2(m, f)$ to provide an estimate of the background noise component $N_1(m, f)$ in P(m, f). ANC 310 then subtracts the estimated background noise component $\hat{N}_1(m, f)$ from P(m, f) using subtractor 330 to provide, as output, the noise suppressed primary input speech signal $\hat{S}_1(m, f)$.

Ideally, no residual amount of the background noise component $N_1(m, f)$ is left in the noise suppressed primary input speech signal $\hat{S}_1(m, f)$. However, because of the time-varying nature of the signals processed by ANC 310 and the inability of the ANC filter to perfectly model the real unknown channel, often some residual amount of the background noise component $N_1(m, f)$ will be left in the noise suppressed primary input speech signal $\hat{S}_1(m, f)$.

To achieve the objective of removing the background noise component $N_1(m, f)$ in the primary input speech signal P(m, f), the transfer function W(f) of adaptive noise canceler filter 325 can be derived (or updated) to substantially minimize the power of the noise suppressed primary input speech signal $\hat{S}_1(m, f)$. In practice the BM is not perfect in removing all desired speech from $\hat{N}_2(m, f)$, and hence it is wise to bias the minimization of the power of the noise suppressed primary input speech signal $\hat{S}_1(m, f)$ to segments of desired speech absence, i.e. noise presence only. The power of the noise suppressed primary input speech signal $\hat{S}_1(m, f)$, also referred to as a cost function, can be expressed as:

$$E_{\hat{S}_1} = \sum_m \sum_f \hat{S}_1(m, f)\hat{S}_1^*(m, f) \quad (27)$$

where ( )* indicates complex conjugate, m indexes the time or frame, and f indexes a particular frequency component or sub-band.

In the following sub-sections, a frequency domain adaptive noise canceler filter 325 and a hybrid approach adaptive noise canceler filter 325 are derived (or updated) based on the cost function expressed in Eq. (27).

2.2.1 Example Derivation of Frequency Domain Adaptive Noise Canceler

The frequency domain adaptive noise canceler filter 325 is derived (or updated) based on a closed form solution below assuming a single complex tap per frequency bin. However, persons skilled in the relevant art(s) will recognize based on the teachings herein that the proposed solution can be generalized to multiple taps per bin.

From FIG. 3:

$$\hat{S}_1(m,f)=P(m,f)-W(f)\hat{N}_2(m,f) \quad (28)$$

where, again, W(f) represents the transfer function of adaptive noise canceler filter 325. The gradient of the cost function $E_{\hat{S}_1}$ expressed in Eq. (27) with respect to the transfer function W(f) of adaptive noise canceler filter 325 is:

$$\nabla_{W(f)}(E_{\hat{S}_1}) = \frac{\partial E_{\hat{S}_1}}{\partial \mathrm{Re}\{W(f)\}} + j\frac{\partial E_{\hat{S}_1}}{\partial \mathrm{Im}\{W(f)\}} \tag{29}$$

$$= \sum_m \hat{S}_1^*(m,f)\frac{\partial \hat{S}_1(m,f)}{\partial \mathrm{Re}\{W(f)\}} + \hat{N}_2(m,f)\frac{\partial \hat{S}_1^*(m,f)}{\partial \mathrm{Re}\{W(f)\}} +$$

$$j\sum_m \hat{S}_1^*(m,f)\frac{\partial \hat{S}_1(m,f)}{\partial \mathrm{Im}\{W(f)\}} + \hat{X}_1(m,f)\frac{\partial \hat{S}_1^*(m,f)}{\partial \mathrm{Im}\{W(f)\}}$$

$$= \sum_m -\hat{S}_1^*(m,f)\hat{N}_2(m,f) - \hat{S}_1(m,f)\hat{N}_2^*(m,f) +$$

$$j\sum_m -\hat{S}_1^*(m,f)j\hat{N}_2(m,f) + \hat{S}_1(m,f)j\hat{N}_2^*(m,f)$$

$$= -2\sum_m \hat{S}_1(m,f)\hat{N}_2^*(m,f)$$

$$= -2\sum_m \left(P(m,f) - W(f)\hat{N}_2(m,f)\right)\hat{N}_2^*(m,f)$$

$$= 2W(f)\left(\sum_m \hat{N}_2(m,f)\hat{N}_2^*(m,f)\right) -$$

$$2\left(\sum_m P(m,f)\hat{N}_2^*(m,f)\right)$$

$$= 0$$

$$\Downarrow$$

$$W(f) = \frac{\sum_m P(m,f)\hat{N}_2^*(m,f)}{\sum_m \hat{N}_2(m,f)\hat{N}_2^*(m,f)} = \frac{C_{P,\hat{N}_2^*}(f)}{C_{\hat{N}_2,\hat{N}_2^*}(f)} \tag{30}$$

where $C_{\hat{N}_2,\hat{N}_2^*}(f)$ and $C_{P,\hat{N}_2}*(f)$ represent time-varying statistics that are given by:

$$C_{\hat{N}_2,\hat{N}_2^*}(f) = \sum_m \hat{N}_2(m,f)\hat{N}_2^*(m,f) \tag{31}$$

$$C_{P,\hat{N}_2^*}(f) = \sum_m P(m,f)\hat{N}_2^*(m,f) \tag{32}$$

$C_{\hat{N}_2,\hat{N}_2^*}(f)$, expressed in Eq. (31), is given by the sum of products of the "cleaner" background noise component $\hat{N}_2(m, f)$ with its own complex conjugate for some number of frames and is essentially the power spectrum of the "cleaner" background noise at frequency f. $C_{\hat{N}_2,\hat{N}_2^*}(f)$ can be referred to as the background noise statistics of the blocking matrix output. $C_{P,\hat{N}_2^*}(f)$, expressed in Eq. (32), is given by the sum of products of the primary input speech, signal P(m, f) and the complex conjugate of the "cleaner" background noise component $\hat{N}_2$ (m, f) for some number of frames and is essentially the cross-spectrum at frequency between the two signals. $C_{P,\hat{N}_2^*}(f)$ can be referred to as the cross-channel background noise statistics.

Collectively, the background noise statistics of the blocking matrix output and the cross-channel background noise statistics can be referred to as the background noise statistics. Further details and variants on the method of calculating the background noise statistics are provided below in section 3.

If BM 305 is effective (in suppressing the desired speech component $S_2(m, f)$ in the "cleaner" background noise component $\hat{N}_2(m, f)$), then the statistics expressed in Eq. (31) and Eq. (32) can be updated each time (or nearly each time) a new frame of primary input speech signal P(m, f) and reference input speech signal R(m, f) is received and processed, regardless of the content on the primary input speech signal P(m, f) and the reference input speech signal R(m, f). However, in an alternative embodiment (and in a potentially safer approach), as mentioned above, the statistics of adaptive noise canceler filter 325 can be updated primarily during periods of time or frames when desired speech is absent.

In the embodiment where adaptive noise canceler filter 325 is implemented in the frequency domain as a multiplication, statistics estimator 345, illustrated in FIG. 3, is configured to derive (or update) estimates of the statistics expressed in Eq. (31) and Eq. (32) and provide the estimates to controller 350, also illustrated in FIG. 3. Controller 350 is then configured to use the estimates of the statistics to configure adaptive noise canceler filter 325. For example, controller 350 can use these values to configure adaptive noise canceler filter 325 in accordance with the transfer function W(f) expressed in Eq. (30), although this is only one example.

2.2.2 Example Derivation of Hybrid Approach Adaptive Noise Canceler Filter

A hybrid variation of adaptive noise canceler filter 325 in accordance with an embodiment of the present invention will now be described. The derivation of the hybrid approach follows that of sub-section 2.1.2 for blocking matrix filter 315.

The hybrid approach changes the "filtering" with the transfer function W(f) from:

$$\hat{N}_1(m,f) = W(f)\hat{N}_2(m,f) \tag{33}$$

to:

$$\hat{N}_1(m,f) = \sum_{k=0}^{K} W(k,f)\hat{N}_2(m-k,f) \tag{34}$$

where m indexes the time or frame, f indexes a particular sub-band, and k=0, 1 . . . K indexes the individual filter coefficients for a particular frequency bin f, making up the noise suppression time direction filter in that particular frequency bin. Hence, the term time direction filter can be used to refer to the individual noise suppression filters that filter the sub-band signals of the "cleaner" background noise component $\hat{N}_2(m, f)$ in the time direction.

Eq. (28) can be rewritten based on Eq. (34) as follows:

$$\hat{S}_1(m,f) = P(m,f) - \sum_{k=0}^{K} W(k,f)\hat{N}_2(m-k,f) \tag{35}$$

Substituting Eq. (35) into Eq. (27), the gradient of $E_{\hat{S}_1}$ with respect to W(k, f) is calculated as:

$$\nabla_{W(k,f)}(E_{\hat{S}_1}) = \frac{\partial E_{\hat{S}_1}}{\partial \mathrm{Re}\{W(k,f)\}} + j\frac{\partial E_{\hat{S}_1}}{\partial \mathrm{Im}\{W(k,f)\}} \tag{36}$$

$$= \sum_m \hat{S}_1^*(m,f)\frac{\partial \hat{S}_1(m,f)}{\partial \mathrm{Re}\{W(k,f)\}} +$$

$$\hat{S}_1(m,f)\frac{\partial \hat{S}_1^*(m,f)}{\partial \mathrm{Re}\{W(k,f)\}} +$$

-continued $$
\begin{aligned}
& j\sum_m \hat{S}_1^*(m,f)\frac{\partial \hat{S}_1(m,f)}{\partial \mathrm{Im}\{W(k,f)\}} + \\
& \hat{S}_1(m,f)\frac{\partial \hat{S}_1^*(m,f)}{\partial \mathrm{Im}\{W(k,f)\}} \\
&= \sum_m -\hat{S}_1^*(m,f)\hat{N}_2(m-k,f) - \hat{S}_1(m,f)\hat{N}_2^*(m-k,f) + \\
& j\sum_m -\hat{S}_1^*(m,f)j\hat{N}_2(m-k,f) + \\
& \hat{S}_1(m,f)j\hat{N}_2^*(m-k,f) \\
&= -2\sum_m \hat{S}_1(m,f)\hat{N}_2^*(m-k,f) \\
&= -2\sum_m \left(P(m,f) - \sum_{l=0}^{K} W(l,f)\hat{N}_2(m-l,f)\right) \\
& \hat{N}_2^*(m-k,f) \\
&= 2\sum_{l=0}^{K} W(l,f)\left(\sum_m \hat{N}_2(m-l,f)\hat{N}_2^*(m-k,f)\right) - \\
& 2\left(\sum_m P(m,f)\hat{N}_2^*(m-k,f)\right) \\
&= 0
\end{aligned}
$$

Eq. (36) is dual to Eq. (13). Similar to sub-section 2.1.2, the set of K+1 equations (for k=0, 1, . . . K) of Eq. (36) provides a matrix equation for every frequency bin f to solve for W(k, f), where k=0, 1, . . . K:

$$
\begin{bmatrix}
\sum_m \hat{N}_2(m,f)\hat{N}_2^*(m,f) & \sum_m \hat{N}_2(m-1,f)\hat{N}_2^*(m,f) & \dots & \sum_m \hat{N}_2(m-K,f)\hat{N}_2^*(m,f) \\
\sum_m \hat{N}_2(m,f)\hat{N}_2^*(m-1,f) & \sum_m \hat{N}_2(m-1,f)\hat{N}_2^*(m-1,f) & \dots & \sum_m \hat{N}_2(m-K,f)\hat{N}_2^*(m-1,f) \\
\vdots & \vdots & \ddots & \vdots \\
\sum_m \hat{N}_2(m,f)\hat{N}_2^*(m-K,f) & \sum_m \hat{N}_2(m-1,f)\hat{N}_2^*(m-K,f) & \dots & \sum_m N_2(m-K,f)\hat{N}_2^*(m-K,f)
\end{bmatrix}
\begin{bmatrix} W(0,f) \\ W(1,f) \\ \vdots \\ W(K,f) \end{bmatrix} =
\begin{bmatrix} \sum_m P(m,f)\hat{N}_2^*(m,f) \\ \sum_m P(m,f)\hat{N}_2^*(m-1,f) \\ \vdots \\ \sum_m P(m,f)\hat{N}_2^*(m-K,f) \end{bmatrix}
\tag{37}
$$

This solution can be written as:

$$\underline{R}_{\hat{N}_2}(f)\cdot\underline{W}(f)=\underline{r}_{P,\hat{N}_2^*}(f) \tag{38}$$

where:

$$\underline{R}_{\hat{N}_2} = \sum_m \underline{\hat{N}}_2^*(m,f)\cdot\hat{N}_2(m,f)^T \tag{39}$$

$$r_{P,\hat{N}_2^*}(f) = \sum_m P(m,f)\cdot\underline{\hat{N}}_2^*(m,f) \tag{40}$$

-continued $$\underline{\hat{N}}_2(m,f) = \begin{bmatrix} \hat{N}_2(m,f) \\ \hat{N}_2(m-1,f) \\ \vdots \\ \hat{N}_2(m-K,f) \end{bmatrix}, \underline{W}(f) = \begin{bmatrix} W(0,f) \\ W(1,f) \\ \vdots \\ W(K,f) \end{bmatrix} \tag{41}$$

and the superscript T denotes non-conjugate transpose. The solution per frequency bin to the time direction filter is thus given by:

$$\underline{W}(f)=(\underline{R}_{\hat{N}_2}(f))^{-1}\cdot\underline{r}_{P,\hat{N}_2^*}(f) \tag{42}$$

This solution appears to require a matrix inversion, but in most practical applications a matrix inversion is not needed.

In the embodiment where adaptive noise canceler filter 325 is implemented based on the hybrid approach, statistics estimator 345 is configured to derive (or update) estimates of the statistics expressed in Eq. (39) and Eq. (40) and provide the estimates to controller 350. Controller 350 is then configured to use the estimates of the statistics to configure adaptive noise canceler filter 325. For example, controller 350 can use these values to configure adaptive noise canceler filter 325 in accordance with the transfer function W(f) expressed in Eq. (42), although this is only one example.

Comparing Eq. (39) and Eq. (40) to Eq. (31) and Eq. (32), respectively, it can be seen that similar statistics are calculated by each set of equations, except that instead of calculating statistics only between current frequency bin components of signals, the hybrid solution requires calculation of statistics between vectors of current and past frequency bin components of signals, i.e. a time dimension is now part of the statistics. At the extreme, with no DFT, i.e. a single full band signal (the time domain signal), the hybrid method becomes a pure time domain method, and hence, the solution above provides the solution also for a pure time domain approach. The frequency index would become obsolete (as there is only one frequency band), and the signal vectors in the time direction would contain the signal time domain samples. A further simplification in that case is that the time domain signal without DFT is real and not complex as in the case of the DFT bins or if a complex sub-band analysis has been applied.

2.2.3 Alternative Approach to Adaptive Noise Canceler

As discussed above, to achieve the objective of removing the background noise component $N_1(m, f)$ in the primary input speech signal P(m, f), the transfer function W(f) of adaptive noise canceler filter 325 can be derived (or updated) to substantially minimize the power of the noise suppressed primary input speech signal $\hat{S}_1(m, f)$ expressed in Eq. (27) during speech absence.

As an alternative method to achieve the objective of removing the background noise component $N_1(m, f)$ in the primary input speech signal P(m, f), the transfer function W(f) of adaptive noise canceler filter 325 can be derived (or updated) to substantially minimize the power of the difference between the desired speech component $S_1(m, f)$ in the primary input speech signal P(m, f) and the output of ANC 310, $\hat{S}_1(m, f)$. The power of the difference between the desired speech component $S_1(m, f)$ and the output of ANC 310, $\hat{S}_1(m, f)$, can be expressed as:

$$E_{\hat{S}_1} = \sum_m \sum_f \left(S_1(m, f) - \hat{S}_1(m, f)\right)\left(S_1(m, f) - \hat{S}_1(m, f)\right)^* \tag{43}$$

where ( )* indicates complex conjugate.

Accommodating the hybrid approach, from Eq. (43) the gradient of $E_{\hat{S}_2}$ with respect to W (k, f) is calculated as:

$$\begin{aligned}
\nabla_{W(k,f)}\left(E_{\hat{S}_1}\right) &= \frac{\partial E_{S_1}}{\partial \mathrm{Re}\{W(k, f)\}} + j\frac{\partial E_{S_1}}{\partial \mathrm{Im}\{W(k, f)\}} \\
&= \sum_m \left(S_1^*(m, f) - \hat{S}_1^*(m, f)\right)\frac{-\partial \hat{S}_1(m, f)}{\partial \mathrm{Re}\{W(k, f)\}} + \\
&\quad \left(S_1(m, f) - \hat{S}_1(m, f)\right)\frac{-\partial \hat{S}_1^*(m, f)}{\partial \mathrm{Re}\{W(k, f)\}} + \\
&\quad j\sum_m \left(S_1^*(m, f) - \hat{S}_1^*(m, f)\right)\frac{-\partial \hat{S}_1(m, f)}{\partial \mathrm{Im}\{W(k, f)\}} + \\
&\quad \left(S_1(m, f) - \hat{S}_1(m, f)\right)\frac{-\partial \hat{S}_1^*(m, f)}{\partial \mathrm{Im}\{W(k, f)\}} \\
&= \sum_m \left(S_1^*(m, f) - \hat{S}_1^*(m, f)\right)\hat{N}_2(m-k, f) + \\
&\quad \left(S_1(m, f) - \hat{S}_1(m, f)\right)\hat{N}_2^*(m-k, f) + \\
&\quad j\sum_m \left(S_1^*(m, f) - \hat{S}_1^*(m, f)\right)j\hat{N}_2(m-k, f) - \\
&\quad \left(S_1(m, f) - \hat{S}_1(m, f)\right)j\hat{N}_2^*(m-k, f) \\
&= 2\sum_m \left(S_1(m, f) - \hat{S}_1(m, f)\right)\hat{N}_2^*(m-k, f) \\
&= 2\sum_m \left(\begin{array}{c} S_1(m, f) - P(m, f) + \\ \sum_{l=0}^{K} W(l, f)\hat{N}_2(m-l, f) \end{array}\right)\hat{N}_2^*(m-k, f) \\
&= 2\sum_{l=0}^{K} W(l, f)\left(\sum_m \hat{N}_2(m-l, f)\hat{N}_2^*(m-k, f)\right) + \\
&\quad 2\left(\sum_m S_1(m, f)\hat{N}_2^*(m-k, f)\right) - \\
&\quad 2\left(\sum_m P(m, f)\hat{N}_2^*(m-k, f)\right) \\
&= 0
\end{aligned} \tag{44}$$

which is written in matrix form as:

$$\underline{R}_{\hat{N}_2}(f)\cdot\underline{W}(f) = \underline{r}_{P,\hat{N}_2^*}(f) - \underline{r}_{S_1,\hat{N}_2^*}(f) \tag{45}$$

where $\underline{R}_{\hat{N}_2}(f)$ and $\underline{r}_{P,\hat{N}_2}(f)$ are defined in sub-section 2.2.2. The last component $\underline{r}_{S_1,\hat{N}_2}(f)$ is given by:

$$r_{\cdots S_1,\hat{N}_2^*}(f) = \sum_m S_1(m, f)\cdot\underline{\hat{N}}_2^*(m, f) \tag{46}$$

and depends on the desired speech component $S_1(m, f)$ in the primary input speech signal P(m, f). The desired speech component $S_1(m, f)$ is generally not available independent of the background noise component $N_1(m, f)$ it the primary input speech signal P(m, f). However, $\underline{r}_{S_1,\hat{N}_2}(f)$ can be calculated based on an assumption of independence between speech and background noise. Given this assumption, Eq. (46) can be expanded as follows:

$$\begin{aligned}
r_{S_1,\hat{N}_2^*}(k, f) &= \sum_m S_1(m, f)\cdot\hat{N}_2^*(m-k, f) \\
&= \sum_m (P(m, f) - N_1(m, f))\cdot \\
&\quad \left(R(m-k, f) - \sum_{l=0}^{K} H(l, f)P(m-k-l, f)\right)^* \\
&= \sum_m P(m, f)\cdot\left(R(m-k, f) - \right. \\
&\quad \left.\sum_{l=0}^{K} H(l, f)P(m-k-l, f)\right)^* - \sum_m N_1(m, f)\cdot \\
&\quad (N_2(m-k, f) + S_2(m-k, f))^* + \sum_m N_1(m, f)\cdot \\
&\quad \left(\sum_{l=0}^{K} H(l, f)(S_1(m-k-l, f) + \right. \\
&\quad \left. N_1(m-k-l, f))\right)^* \\
&\approx r_{P,R^*}(k, f) - \sum_{l=0}^{K} H^*(l, f)r_{P,P^*}(k+l, f) - \\
&\quad r_{N_1,N_2^*}(k, f) + \sum_{l=0}^{K} H^*(l, f)r_{N_1,N_2^*}(k+l, f) \\
&= r_{P,R^*}(k, f) - r_{N_1,N_2^*}(k, f) - \\
&\quad \sum_{l=0}^{K} H^*(l, f)\left(r_{P,P^*}(k+l, f) - r_{N_1,N_1^*}(k+l, f)\right)
\end{aligned} \tag{47}$$

For the general hybrid version, the solution is given by:

$$\underline{W}(f) = (f)) = (\underline{R}_{\hat{N}_2}(f))^{-1}\cdot(\underline{r}_{P,\hat{N}_2^*}(f) - \underline{r}_{S_1,N_2^*}(f)) \tag{48}$$

and the special $0^{th}$ order hybrid (non-hybrid, both BM and ANC) version has the following solution:

$$W(f) = \frac{r_{P,\hat{N}_2^*}(0, f) + r_{N_1,N_2^*}(0, f) - r_{P,R^*}(0, f) + H^*(f)\left(r_{P,P^*}(0, f) - r_{N_1,N_1^*}(0, f)\right)}{r_{\hat{N}_2,\hat{N}_2^*}(0, f)} \tag{49}$$

With a hybrid BM and non-hybrid ANC, the solution is given by:

$$W(f) = \frac{r_{P,\hat{N}_2^*}(0, f) + r_{N_1,N_2^*}(0, f) - r_{P,R^*}(0, f) + \sum_{k=0}^{K} H^*(k, f)\left(r_{P,P^*}(k, f) - r_{N_1,N_1^*}(k, f)\right)}{r_{\hat{N}_2,\hat{N}_2^*}(0, f)} \quad (50)$$

In this alternative approach, statistics estimator 345 is configured to derive (or update) estimates of the statistics expressed in Eq. (39) and/or Eq. (40) and/or Eq. (47) and provide the estimates to controller 350. Controller 350 is then configured to use the estimates of the statistics to configure adaptive noise canceler filter 325. For example, controller 350 can use these values to configure adaptive noise canceler filter 325 in accordance with the transfer function W(f) expressed in Eq. (48), Eq. (49), or Eq. (50).

3. Estimation of Time-Varying Statistics

As described above in sub-sections 2.1 and 2.2, the closed-form solutions for blocking matrix filter 315 and adaptive noise canceler filter 325 require various statistics to be estimated. In practice, these statistics need to be estimated from the primary input speech signal P(m, f) and the reference input speech signal R(m, f) that contain desired speech mixed with background noise. The statistics will generally vary with time due to, for example, the position of the desired speech source relative to primary speech microphone 104 and noise reference microphone 106 changing, the position of the background noise source(s) relative to primary speech microphone 104 and noise reference microphone 106 changing, etc. The present section describes methods and features that will facilitate the estimation of the time-varying statistics used to solve the closed-form solutions for blocking matrix filter 315 and adaptive noise canceler filter 325 described above in sub-sections 2.1 and 2.2.

3.1 Estimation of Time-Varying Statistics for the Blocking Matrix Filter

As described above in sub-section 2.1.1, deriving (or updating) blocking matrix filter 315 requires knowledge of the statistics $C_{R,P^*}(f)$ and $C_{P,P^*}(f)$, which can be calculated during periods of time (or frames) of predominantly desired speech. The statistics were expressed generally in Eq. (8) and Eq. (9), reproduced below:

$$C_{R,P^*}(f) = \sum_m R(m, f)P^*(m, f) \quad (8)$$

$$C_{P,P^*}(f) = \sum_m P(m, f)P^*(m, f) \quad (9)$$

The condition that these statistics be calculated during predominantly desired speech can be quantified to update when the energy of the desired speech is greater than the energy of the background noise in primary input speech signal P(m, f) by a large degree. It means that reference input speech signal R(m, f) and primary input speech signal P(m, f) generally include primarily desired speech. Thus, the calculation of $C_{R,P^*}(f)$ as the sum of products of the reference input speech signal R(m, f) and the complex conjugate primary input speech signal P(m, f) at a given frequency bin f for some number of frames can be seen as a way of estimating the cross-spectrum at that frequency bin between the desired speech component in the reference input speech signal R(m, f) and the desired speech component in the primary input speech signal P(m, f). Consequently, and as noted above, $C_{R,P^*}(f)$ can be referred to as the cross-channel statistics of the desired speech, or just desired speech cross-channel statistics.

Similarly, the calculation of $C_{P,P^*}(f)$ as the sum of products of the primary input speech signal P(m, f) and its own complex conjugate at a given frequency bin f for some number of frames can be seen as a way of estimating the power spectrum at that frequency bin of the desired speech component in the primary input speech signal P(m, f). Consequently, and as noted above, $C_{P,P^*}(f)$ can be referred to as the desired speech statistics of the primary input speech signal.

Collectively, the cross-channel statistics of the desired speech and desired speech statistics of the primary input speech signal can be referred to as simply the desired speech statistics.

To accommodate the time varying nature of $C_{R,P^*}(f)$ and $C_{P,P^*}(f)$ expressed in Eq. (8) and Eq. (9), these statistics can be estimated using a time window (as is done in Eq, (8) and Eq. (9)) or using a moving average. The calculation of the statistics using a moving average can be expressed as:

$$C_{R,P^*}(m,f)=\alpha(m)\cdot C_{R,P^*}(m-1,f)+(1-\alpha(m))\cdot R(m,f)P^*(m,f) \quad (51)$$

$$C_{P,P^*}(m,f)=\alpha(m)\cdot C_{P,P^*}(m-1,f)+(1-\alpha(m))\cdot P(m,f)P^*(m,f) \quad (52)$$

where ( )* indicates complex conjugate, m indexes the time or frame, f indexes a particular frequency component, bin, or sub-band, and α(m) is an adaptation factor, which itself is time-varying.

It should be noted that the moving averages expressed in Eq. (51) and Eq. (52), commonly referred to as exponential moving averaging or exponentially weighted moving averaging, are provided for exemplary purposes only and are not intended to be limiting. Persons skilled in the relevant art(s) will recognize that other moving average expressions can be used.

The adaptation factor α(m) is adjusted in time such that it has a smaller value that is less than one and greater than zero as the likelihood of predominantly desired speech increases, and a comparatively larger value that is closer to one as the likelihood of predominantly desired speech decreases. In practice this can be achieved by adjusting α(m) to a smaller value when the energy of the desired speech is likely greater than the energy of the background noise in a current frame of the primary input speech signal P(m, f) by a large degree (resulting in $C_{R,P^*}(f)$ and $C_{P,P^*}(f)$ being updated quickly), and is adjusted in time such that is has a comparatively large value (e.g., a value around 1) when the energy of the desired speech is not likely to be greater than the energy of the background noise in the current frame of the primary input speech signal P(m, f) by a large degree (resulting in $C_{R,P^*}(f)$ and $C_{P,P^*}(f)$ being updated slowly, or not at all when α(m) is equal to one).

The adaptation factor α(m) can be determined, for example, based on a difference in energy between a current frame of the primary input speech signal P(m, f) received by primary speech microphone 104 and a current frame of the reference input speech signal R(m, f) received by noise reference microphone 106. The difference in energy can be calculated by subtracting the log-energy of the current frame of the reference input speech signal from the log-energy of the current frame of the primary input speech signal in at least one example.

For instance, if the difference in energy is 16 dB or higher (indicating likelihood of desired speech dominating any background noise present in the current frame of the primary input speech signal P(m, f)), α(m) can be set equal to a smaller value and, if the difference in energy is 6 dB or less (indicating likelihood of background noise dominating any desired speech present in the current frame of the primary input speech signal P(m, f)), α(m) can be set equal to a comparatively larger value, while a piecewise linear mapping from difference in energy to α(m) can be used in-between these two values. In general, the piecewise linear mapping can be monotonically decreasing in-between the two points.

Figure 4:
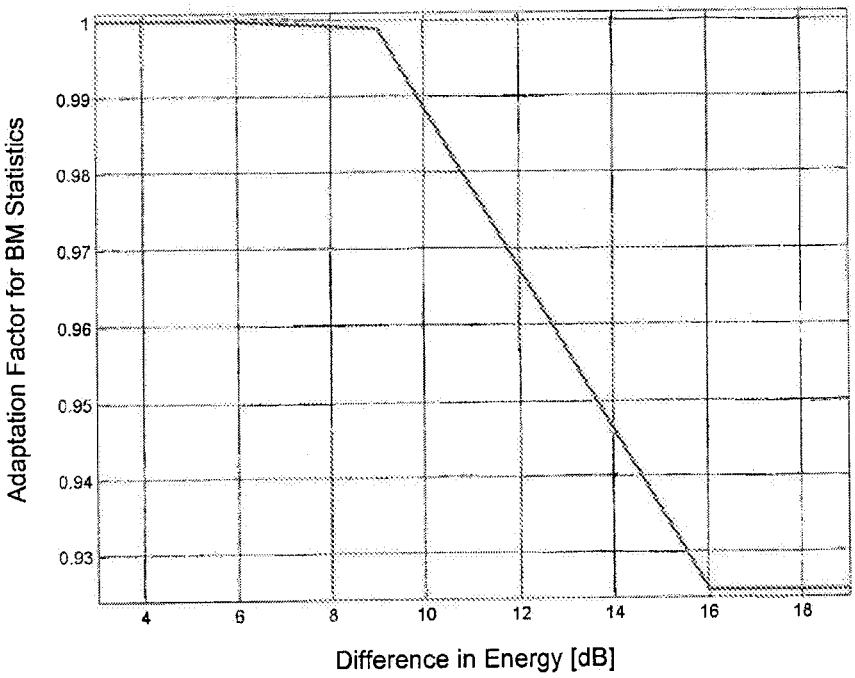
FIG. 4 illustrates an example piecewise linear mapping from difference in energy between a primary input speech signal and a reference input speech signal to adaptation factor for the blocking matrix statistics in accordance with an embodiment of the present invention.

An example piecewise linear mapping 400 from difference in energy between the primary input speech signal P(m, f) and the reference input speech signal R(m, f) to adaptation factor α(m) is illustrated in FIG. 4. It should be noted that piecewise linear mapping 400 is provided for illustrative purposes only and is not intended to be limiting. Persons skilled in the relevant art(s) will recognize that other mappings are possible. For example, a non-linear piecewise mapping can be used.

Using a mapping from difference in energy to α(m) as described above, generally means that the statistics expressed in Eq. (51) and Eq. (52) will be updated at a rate directly related to the difference in energy between the primary input speech signal P(m, f) and the reference input speech signal R(m, f).

Figure 5:
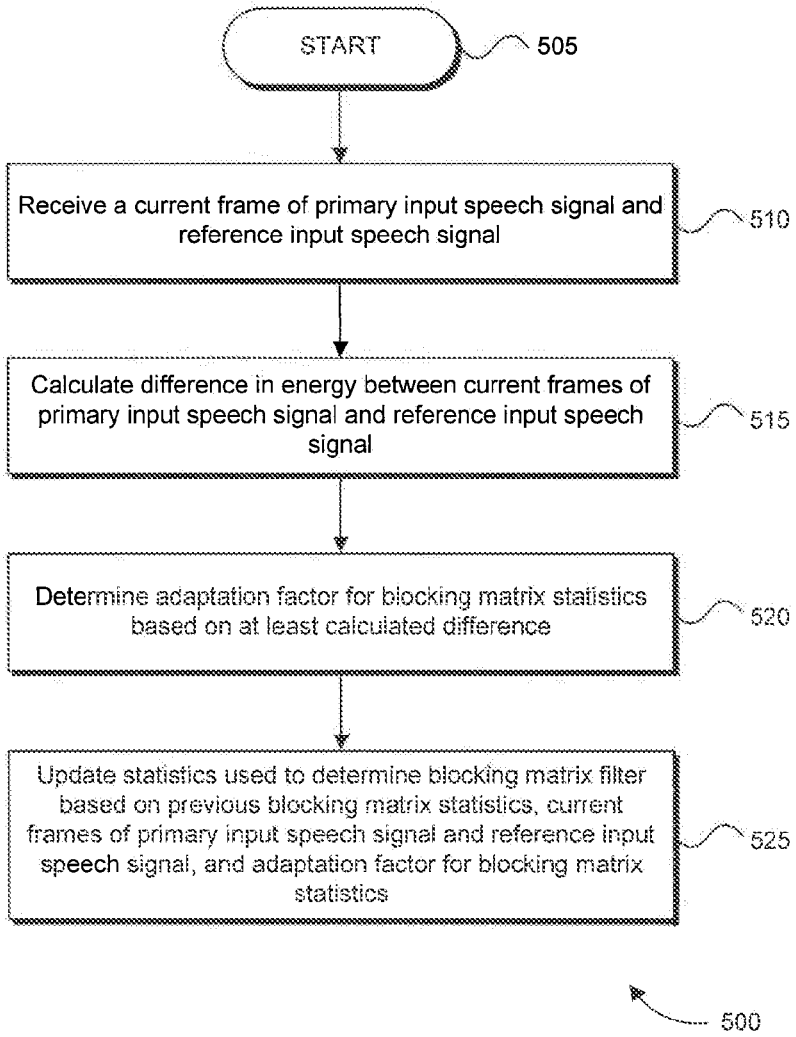
FIG. 5 illustrates a flowchart of a method for estimating time-varying statistics for a closed-form solution of a blocking matrix filter in accordance with an embodiment of the present invention.

FIG. 5 depicts a flowchart 500 of a method for estimating the time-varying statistics of blocking matrix filter 315, illustrated in FIG. 3, in accordance with an embodiment of the present invention. The method of flowchart 500 can be performed, for example and without limitation, by statistics estimator 335 as described above in reference to FIG. 3. However, the method is not limited to that implementation.

As shown in FIG. 5, the method of flowchart 500 begins at step 505 and immediately transitions to step 510. At step 510, a current frame of the primary input speech signal P(m, f) and the reference input speech signal R(m, f) are received.

At step 515, a difference in energy between the current frame of the primary input speech signal P(m, f) and the reference input speech signal R(m, f) is calculated. For example, the difference in energy can be calculated by subtracting the log-energy of the current frame of the reference input speech signal R(m, f) from the log-energy of the current frame of the primary input speech signal P(m, f) in at least one example.

At step 520, the adaptation factor α(m) is determined, based on at least the difference in energy calculated at step 515. For example, the adaptation factor α(m) can be determined based on a piecewise linear mapping from the difference in energy calculated at step 515 to α(m). FIG. 4 illustrates one possible piecewise linear mapping 400, although other non-linear mappings can be used to determine the adaptation factor α(m).

It should be noted that information other than the difference in energy calculated at step 515 can be used to determine the adaptation factor α(m). For example, a voice activity indicator provided by a voice activity detector (not shown) can be used in combination with the difference in energy calculated at step 515 to determine the adaptation factor α(m).

At step 525, the statistics used to determine blocking matrix filter 315 are updated based on the previous values of the statistics, the current frame of the primary input speech signal P(m, f) and the reference input speech signal R(m, f), and the adaptation factor α(m). For example, the cross-channel statistics of the desired speech $C_{R,P^*}(m, f)$ can be updated according to Eq. (51) above using the previous value of the cross-channel statistics of the desired speech statistics $C_{R,P^*}(m-1, f)$, the current frame of the primary input speech signal P(m, f) and the reference input speech signal R(m, f), and the adaptation factor α(m). Similarly, the desired speech statistics of the primary input speech signal $C_{P,P^*}(m, f)$ can be updated according to Eq. (52) above using the previous value of the desired speech statistics of the primary input speech signal $C_{P,P^*}(m-1, f)$, the current frame of the primary input speech signal P(m, f), and the adaptation factor α(m).

3.1.1 Improved Estimation of Clean Speech Statistics

If there are plenty of frames where the desired speech dominates the background noise in the primary input speech signal P(m, f), then even if there is some background noise, the statistics $C_{R,P^*}(f)$ and $C_{P,P^*}(f)$ expressed by Eq. (51) and Eq. (52), respectively, can be estimated directly from the primary input speech signal P(m, f) and the reference input speech signal R(m, f) with sufficient accuracy. However, to gain robustness to higher levels of background noise, it may be advantageous to estimate the statistics $C_{R,P^*}(f)$ and $C_{P,P^*}(f)$ in a more advanced manner. For example, the statistics of the stationary portion of the background noise components $N_1(m, f)$ and $N_2(m, f)$ can be further estimated and removed when estimating the statistics $C_{R,P^*}(f)$ and $C_{P,P^*}(f)$ as follows:

$$C_{R,P^*}(m,f)=\alpha(m)\cdot C_{R,P^*}(m-1,f)+(1-\alpha(m))\cdot[R(m,f)P^*(m,f)-C_{N_2,N_1^*}^{stationary}(m,f)] \quad (53)$$

$$C_{P,P^*}(m,f)=\alpha(m)\cdot C_{P,P^*}(m-1,f)+(1-\alpha(m))\cdot[P(m,f)P^*(m,f)-C_{N_2,N_1^*}^{stationary}(m,f)] \quad (54)$$

where $C_{N_2,N_1^*}^{stationary}(m, f)$ is the cross-channel statistics of the stationary background noise, or just stationary background noise cross-channel statistics, determined based on the product of the background noise component $N_1(m, f)$ and the complex conjugate of $N_2(m, f)$ at a given frequency bin f, and $C_{N_1,N_1^*}^{stationary}(m, f)$ is the stationary background noise statistics of the primary input speech signal determined based on the product of the background noise component $N_1(m, f)$ and its own complex conjugate at a given frequency bin f. Collectively, the cross-channel statistics of the stationary background noise and the stationary background noise statistics of the primary input speech signal can be referred to as simply the stationary background noise statistics.

More specifically, the statistics, $C_{N_2,N_1^*}^{stationary}(m, f)$ and $C_{N_1,N_1^*}^{stationary}(m, f)$ can be estimated from a moving average of input statistics as follows:

$$C_{N_2,N_1^*}^{stationary}(m,f)=\alpha_S(m)\cdot C_{N_2,N_1^*}^{stationary}(m-1,f)+(1-\alpha_S(m))\cdot[R(m,f)P^*(m,f)] \quad (55)$$

$$C_{N_1,N_1^*}^{stationary}(m,f)=\alpha_S(m)\cdot C_{N_1,N_1^*}^{stationary}(m-1,f)+(1-\alpha_S(m))\cdot[P(m,f)P^*(m,f)] \quad (56)$$

where $\alpha_S(m)$ is an adaptation factor.

It should be noted that the moving averages expressed in Eq. (55) and Eq. (56), commonly referred to as exponential moving averaging, are provided for exemplary purposes only and are not intended to be limiting. Persons skilled in the relevant art(s) will recognize that other moving average expressions can be used.

The adaptation factor $\alpha_S(m)$ can be determined, for example, based on a difference in energy between a current frame of the primary input speech signal P(m, f) and a current frame of the reference input speech signal R(m, f). For instance, if the difference in energy is −3 dB or less (indicating likelihood of background noise dominating any desired speech in the current frame of the primary input speech signal P(m, f)), $\alpha_S(m)$ can be set equal to a small value between zero and one and, if the difference in energy is 6 dB or higher (indicating likelihood of desired speech dominating any background noise present in primary input speech signal P(m, f)), $\alpha_S(m)$ can be set equal to a comparatively larger value close to one (or exactly equal to one), while a piecewise linear mapping from difference in energy to $\alpha_S(m)$ can be used in-between these two values. In general, the piecewise linear mapping can be monotonically increasing in-between the two points.

Figure 6:
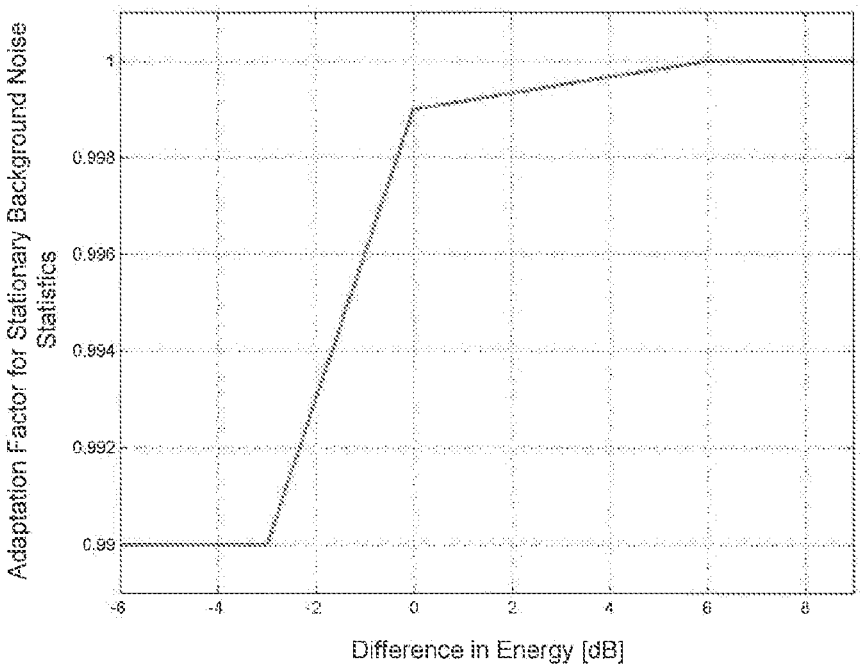
FIG. 6 illustrates an example piecewise linear mapping from difference in energy between a primary input speech signal and a reference input speech signal to adaptation factor for estimating statistics of stationary noise in accordance with an embodiment of the present invention.

An example piecewise linear mapping 600 from difference in energy between the primary input speech signal P(m, f) and the reference input speech signal R(m, f) to adaptation factor $\alpha_S(m)$ is illustrated in FIG. 6. Compared to the mapping for $\alpha(m)$ above it can be seen that different points are used to suggest certain likelihood of speech and noise. Such differences are generally present due to a desire to bias/err in certain directions depending on the usage of the information. It should be noted that piecewise linear mapping 600 is provided for illustrative purposes only and is not intended to be limiting. Persons skilled in the relevant art(s) will recognize that other mappings are possible. For example, a non-linear, piecewise mapping can be used.

Using a mapping from difference in energy to $\alpha_S(m)$ as described above, generally means that the statistics expressed in Eq. (55) and Eq. (56) will be updated at a rate inversely related to the difference in energy between the primary input speech signal P(m, f) and the reference input speech signal R(m, f).

Figure 7:
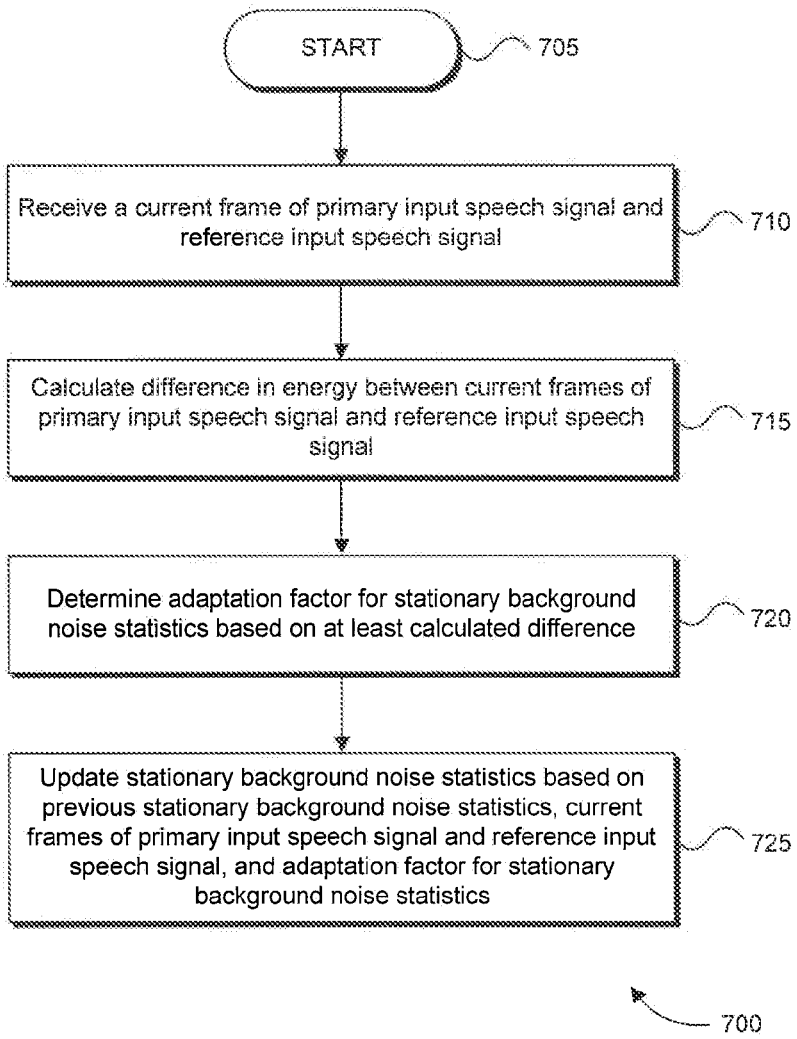
FIG. 7 illustrates a flowchart of a method for estimating time-varying stationary background noise statistics in accordance with an embodiment of the present invention.

FIG. 7 depicts a flowchart 700 of a method for estimating the time-varying stationary background noise statistics in accordance with an embodiment of the present invention. The method of flowchart 700 can be performed, for example and without limitation, by statistics estimator 335 as described above in reference to FIG. 3. However, the method is not limited to that implementation.

As shown in FIG. 7, the method of flowchart 700 begins at step 705 and immediately transitions to step 710. At step 710, a current frame of the primary input speech signal P(m, f) and the reference input speech signal R(m, f) are received.

At step 715, a difference in energy between the current frame of the primary input speech signal P(m, f) and the reference input speech signal R(m, f) is calculated. For example, the difference in energy can be calculated by subtracting the log-energy of the current frame of the reference input speech signal R(m, f) from the log-energy of the current frame of the primary input speech signal P(m, f) in at least one example.

At step 720, the adaptation factor $\alpha_S(m)$ is determined, based on at least the difference in energy calculated at step 715. For example, the adaptation factor $\alpha_S(m)$ can be determined based on a piecewise linear mapping from the difference in energy calculated at step 715 to $\alpha_S(m)$. FIG. 6 illustrates one possible piecewise linear mapping 600, although other non-linear mappings can be used to determine the adaptation factor $\alpha_S(m)$.

It should be noted that information other than the difference in energy calculated at step 715 can be used to determine the adaptation factor $\alpha_S(m)$. For example, a voice activity indicator provided by a voice activity detector (not shown) can be used in combination with the difference in energy calculated at step 715 to determine the adaptation factor $\alpha_S(m)$.

At step 725, the stationary background noise statistics are updated based on the previous values of the stationary background noise statistics, the current frame of the primary input speech signal P(m, f) and the reference input speech signal R(m, f), and the adaptation factor $\alpha_S(m)$. For example, the stationary background noise cross-channel statistics $C_{N_2,N_1^*}^{stationary}(m, f)$ can be updated according to Eq. (55) above using the previous value of the stationary background noise cross-channel statistics $C_{N_2,N_1^*}^{stationary}(m-1, f)$, the current frame of the primary input speech signal P(m, f) and the reference input speech signal R(m, f), and the adaptation factor $\alpha_S(m)$. Similarly, the stationary background noise statistics of the primary input speech signal $C_{N_1,N_1^*}^{stationary}(m, f)$ can be updated according to Eq. (56) above using the previous value of the stationary background noise statistics of the primary input speech signal $C_{N_1,N_1^*}^{stationary}(m-1, f)$, the current frame of the primary input speech signal P(m, f), and the adaptation factor $\alpha_S(m)$.

3.1.2 Local Variations in Microphone Levels due to Acoustic Factors

In operation of multi-channel noise suppression system 300 illustrated in FIG. 3, it is possible for one or both of primary speech microphone 104 and noise reference microphone 106 to become shielded for a temporary amount of time. For example, a finger or hair can partially shield primary speech microphone 104 or noise reference microphone 106 for some indeterminate period of time. As a result, the energy of the input speech signal received by the shielded microphone may be below the energy of the input speech signal that would otherwise have been received if it were not shielded. This variation can undermine the effectiveness of using the difference in energy between the primary input speech signal P(m, f) received by primary speech microphone 104 and the reference input speech signal R(m, f) received by noise reference microphone 106 to determine the adaptation factors and time-varying statistics as discussed above in the preceding sub-sections. Therefore, it can be beneficial to take this variation into account.

In one potential solution to take this variation into account, local variations in the level of primary speech microphone 104 and noise reference microphone 106 due to acoustical factors can be respectively calculated based on the following moving averages:

$$M_P^{lev}(m)=\alpha_S\cdot M_P^{lev}(m-1)+(1-\alpha_S)\cdot M_P(m) \tag{57}$$

$$M_R^{lev}(m)=\alpha_S\cdot M_R^{lev}(m-1)+(1-\alpha_S)\cdot M_R(m) \tag{58}$$

where $\alpha_S$ is determined based on the piecewise linear mapping in FIG. 6, and $M_P(m)$ and $M_R(m)$ respectively represent the energies or levels of primary input speech signal P(m, f) and reference input speech signal R(m, f) and are given by:

$$M_P(m) = 10\cdot\log_{10}\left(\sum_f |P(m, f)|^2\right) \tag{59}$$

$$M_R(m) = 10\cdot\log_{10}\left(\sum_f |R(m, f)|^2\right) \tag{60}$$

The difference between the moving averages expressed in Eq. (59) and Eq. (60) can then be used to compensate for any variation in the microphone input levels due to acoustical factors. For example, the function used to map the difference in energy of the primary input speech signal P(m, f) and the reference input speech signal R(m, f) to the adaptation factor $\alpha(m)$ can be offset by the difference between the moving averages expressed in Eq. (59) and Eq. (60) to provide compensation. Assuming the mapping function illustrated in the plot of FIG. 4 is used, the offset can be seen as a shift of each point (either left or right) in the plot by the estimated effective loss.

3.1.3 Accommodating Changes in Acoustic Coupling Specific to Primary Speech

In operation of multi-channel noise suppression system 300 illustrated in FIG. 3, it is further possible for the desired speech source to move relative to primary speech microphone 104 and noise reference microphone 106, thereby changing the acoustic coupling, between the desired speech source and the two microphones. For instance, in the example where multi-channel noise suppression system 300 is implemented in wireless communication device 102, illustrated in FIG. 1, a user can make minor adjustments to the position of wireless communication device 102 during a call, such as by moving the wireless communication device 102 closer or farther away from his or her mouth. These adjustments in position can significantly change the acoustic coupling between the user's mouth and the two microphones. As a result, the energy of the desired speech component within the input speech signals received by the two microphones may be increased or reduced artificially based on the change in position. This variation in the energy of the desired speech component received can undermine the effectiveness of using the difference in energy between the primary input speech signal P(m, f) and the reference input speech signal R(m, f) to determine the adaptation factors and time-varying statistics as discussed above in the preceding sub-sections. Therefore, it may be beneficial to take this potential variation into account.

In one potential solution to take this potential variation into account, a moving average is maintained of the difference in energy of a current frame of the primary input speech signal P(m, f) and a current frame of the reference input speech signal R(m, f) and compared to a reference value. More specifically, the moving average is updated based on the difference in energy between a current frame of the primary input speech signal P(m, f) and a current frame of the reference input speech signal R(m, f) if the frame of the primary input speech signal P(m, f) is indicated as including desired speech. The degree to which the moving average is updated based on each frame can be controlled using a smoothing factor. For example, the smoothing factor can be set to a value that updates the moving average to be equal to 0.99 of the previous moving average value and 0.01 of the difference in energy of the current frame of the primary input speech signal P(m, f) and the current frame of the reference input speech signal R(m, f), assuming the current frame of the primary input speech signal P(m, f) is indicated as including desired speech.

The reference value, to which the moving average is compared, can be determined as a typical difference in energy between the primary input speech signal P(m, f) and the reference input speech signal R(m, f) for desired speech when the desired speech source is in its nominal (i.e., intended) position relative to the two microphones.

As an example of this feature, if the user's mouth is in its nominal position relative to the two microphones of wireless communication device 102 during a call, the presence of desired speech may be highly likely if the difference in energy between the primary input speech signal P(m, f) and the reference input speech signal R(m, f) is above 10 dB. On the other hand, if the user's mouth is not in its nominal position relative to the two microphones of wireless communication device 102 during a call (e.g., the user's mouth is farther away from at least primary speech microphone 104), then the presence of desired speech may be highly likely if the difference in energy between the primary input speech signal P(m, f) and the reference input speech signal R(m, f) is above 6 dB. Thus, there is an effective loss in coupling of 4 dB for the desired speech because of the mismatch in the position of the user's mouth during the call from its nominal position relative to the two microphones. It should be noted that although the coupling for desired speech was reduced by 4 dB by moving the handset into a suboptimal position, the coupling for noise sources remains about the same (as they are far-field to the device for all practical purposes). Hence, this change in coupling only applies to desired speech.

By keeping track of a moving average of the difference in energy of the primary input speech signal P(m, f) and the reference input speech signal R(m, f) for desired speech as discussed above, and comparing the moving average to a reference value as further discussed above, the effective loss due to suboptimal acoustic coupling for the desired speech can be estimated. This estimated effective loss can then be used to compensate for any actual loss due to suboptimal acoustic coupling for the desired speech. For example, the function used to map the difference in energy of the primary input speech signal P(m, f) and the reference input speech signal R(m, f) to the adaptation factor $\alpha(m)$ can be offset by the estimated effective loss to provide compensation. Assuming the mapping function illustrated in the plot of FIG. 4 is used, the offset can be seen as a shift of each point (either left or right) in the plot by the estimated effective loss.

In order to update the moving average based on the difference in energy of a current frame of the primary input speech signal P(m, f) and a current frame of the reference input speech signal R(m, f) when desired speech is indicated to be present in the frame of the primary input speech signal P(m, f), it is obviously necessary to first identify the presence of desired speech. This can be done using several methods. For example, the presence of desired speech can be determined based on whether: (1) an SNR of the primary input speech signal P(m, f) is above a certain threshold; (2) a difference in energy of the primary input speech signal P(m, f) and the reference input speech signal R(m, f) is above a certain threshold; and/or (3) a prediction gain of the reference input speech signal R(m, f) from the primary input speech signal P(m, f) using a blocking matrix with a null forced in the direction of the expected desired speech is above a certain threshold. In one embodiment, at least two of these methods are used to determine the presence of desired speech in a frame of the primary input speech signal P(m, f).

3.2 Estimation of Time-Varying Statistics for the Adaptive Noise Canceler

As described above in sub-section 2.2.1, deriving (or updating) adaptive noise canceler filter 325 requires knowledge of the statistics $C_{\hat{N}_2,\hat{N}_2^*}(f)$ and $C_{P,\hat{N}_2^*}(f)$. The statistics were expressed generally in Eq. (31) and Eq. (32), reproduced below:

$$C_{\hat{N}_2,\hat{N}_2^*}(f) = \sum_m \hat{N}_2(m, f)\hat{N}_2^*(m, f) \tag{31}$$

$$C_{P,\hat{N}_2^*}(f) = \sum_m P(m, f)\hat{N}_2^*(m, f) \tag{32}$$

$C_{\hat{N}_2,\hat{N}_2^*}(f)$, expressed in Eq. (31), is given by the sum of products of the "cleaner" background noise component $\hat{N}_2(m, f)$ and its own complex conjugate at a given frequency bin f for some number of frames (i.e., the power spectrum of the "cleaner" background noise component $\hat{N}_2(m, f)$) and can be referred to as the background noise statistics. $C_{P,\hat{N}_2^*}(f)$ expressed in Eq. (32), is given by the sum of the products of the primary input speech signal P(m, f) and the complex conjugate "cleaner" background noise component $\hat{N}_2(m, f)$ at a given frequency bin f for some number of frames (i.e., the cross-spectrum at that frequency bin between the primary input speech signal P(m, f) and the complex conjugate "cleaner" background noise component $\hat{N}_2(m, f)$) and can be referred to as the cross-channel background noise statistics.

To accommodate the time varying nature of $C_{\hat{N}_2,\hat{N}_2^*}(f)$ and $C_{P,\hat{N}_2^*}(f)$ expressed in Eq. (31) and Eq. (32), these statistics can be estimated using a time window (as is done in Eq. (31) and Eq. (32)) or using a moving average. The calculation of the statistics using a moving average can be expressed as:

$$C_{P,\hat{N}_2^*}(m,f)=\gamma(m)\cdot C_{P,\hat{N}_2^*}(m-1,f)+(1-\gamma(m))\cdot P(m,f)\hat{N}_2^*(m,f) \tag{61}$$

$$C_{\hat{N}_2,\hat{N}_2^*}(m,f)=\gamma(m)\cdot C_{\hat{N}_2,\hat{N}_2^*}(m-1,f)+(1-\gamma(m))\cdot \hat{N}_2(m,f)\hat{N}_2^*(m,f) \tag{62}$$

where ()* indicates complex conjugate, m indexes the time or frame, f indexes a particular frequency component or sub-band, and $\gamma(m)$ is an adaptation factor.

It should be noted that the moving averages expressed in Eq. (61) and Eq. (62), commonly referred to as exponential moving averages or exponentially weighted moving averages, are provided for exemplary purposes only and are not intended to be limiting. Persons skilled in the relevant art(s) will recognize that other moving average expressions can be used.

If BM 305 is operating well and providing the "cleaner" background noise component $\hat{N}_2(m, f)$ with little or no residual amount of the desired speech component $S_2(m, f)$, then the adaptation factor $\gamma(m)$ can be set to a constant. However, if BM 305 is not operating perfectly and a residual amount of the desired speech component $S_2(m, f)$ is left in the "cleaner" background noise component $\hat{N}_2(m, f)$, setting the adaptation factor $\gamma(m)$ to a constant can result in distortion or cancellation of the desired speech. Therefore, the adaptation factor $\gamma(m)$ can be varied over time according to the likelihood of desired speech being present, and the updating of the statistics expressed in Eq. (61) and in Eq. (62) can be effectively halted when the likelihood of desired speech being present is high.

For the statistics used to derive (or update) blocking matrix filter 315, the difference in energy between a current frame of the primary input speech signal P(m, f) and a current frame of the reference input speech signal R(m, f) was used as an indicator of speech presence and as an input parameter to determine the adaptation factor $\alpha(m)$. In a similar manner, the difference in energy between a current frame of the primary input speech signal P(m, f) and a current frame of the reference input speech signal R(m, f) can be used as an indicator of speech presence and as an input parameter to determine the adaptation factor $\gamma(m)$. However, given that BM 305 removed desired speech from reference input speech signal R(m, f) (at least partially) to produce the "cleaner" background noise component $\hat{N}_2(m, f)$, the difference in energy, or a moving average of the difference in energy, between a current frame of the primary input speech signal P(m, f) and a current frame of the "cleaner" background noise component $\hat{N}_2(m, f)$ can alternatively be used as an indicator of speech presence and as an input parameter to determine the adaptation factor $\gamma(m)$. In fact, using the "cleaner" background noise component $\hat{N}_2(m, f)$ as opposed to the reference input speech signal R(m, f) can provide better discrimination, assuming BM 305 is functioning well.

As mentioned above, the statistics expressed in Eq. (61) and Eq. (62) for adaptive noise canceler filter 325 represent statistics of the background noise. Thus, the rate at which the statistics are updated will affect the ability of the overall noise suppression system to track and suppress moving background noise sources, e.g. a talking person walking by, a moving vehicle driving by, etc. Updating the statistics expressed in Eq. (61) and Eq. (62) at a fast pace will allow good tracking and suppression of moving noise sources. On the other hand, a fast update pace can potentially degrade steady-state suppression of stationary background noise sources. Therefore, a method referred to as dual adaptive noise cancelation can be used, where a set of statistics are maintained and updated at a fast rate (favoring moving noise sources) and a set of statistics are maintained and updated a slow rate (favoring steady-state performance). Prior to applying adaptive noise canceler filter 325, one of the two sets of statistics is selected and used to configure the filter.

For example, the following two sets of the statistics expressed in Eq. (61) and Eq. (62) can be maintained $$C_{P,\hat{N}_2^*}^{fast}(m,f)=\gamma_{fast}(m)\cdot C_{P,\hat{N}_2^*}^{fast}(m-1,f)+(1-\gamma_{fast}(m))\cdot P(m,f)\hat{N}_2^*(m,f) \tag{63}$$

$$C_{\hat{N}_2,\hat{N}_2^*}^{fast}(m,f)=\gamma_{fast}(m)\cdot C_{\hat{N}_2,\hat{N}_2^*}^{fast}(m-1,f)+(1-\gamma_{fast}(m))\cdot \hat{N}_2(m,f)\hat{N}_2^*(m,f) \tag{64}$$

and $$C_{P,\hat{N}_2^*}^{slow}(m,f)=\gamma_{slow}(m)\cdot C_{P,\hat{N}_2^*}^{slow}(m-1,f)+(1-\gamma_{fast}(m))\cdot P(m,f)\hat{N}_2^*(m,f) \tag{65}$$

$$C_{\hat{N}_2,\hat{N}_2^*}^{slow}(m,f)=\gamma_{slow}(m)\cdot C_{\hat{N}_2,\hat{N}_2^*}^{slow}(m-1,f)+(1-\gamma_{slow}(m))\cdot \hat{N}_2(m,f)\hat{N}_2^*(m,f) \tag{66}$$

where Eq. (63) and Eq. (64) represent the set of statistics updated at a fast rate (hence, the use of the fast adaptation factor $\gamma_{fast}(m)$, and Eq. (65) and Eq. (66) represent the set of statistics updated at a slow rate (hence, the use of the slow adaptation factor $\gamma_{slow}(m)$).

As discussed above, the adaptation factors $\gamma_{fast}(m)$ and $\gamma_{slow}(m)$ can be determined, for example, based on the difference in energy, or a moving average of the difference in energy, between a current frame of the primary input speech signal P(m, f) and a current frame of the "cleaner" background noise component $\hat{N}_2(m, f)$. FIG. 8 illustrates example piecewise linear mappings 805 and 810 that can be used to map the difference in energy (or moving average of the difference in energy) between a current frame of the primary input speech signal P(m, f) and a current frame of the "cleaner" background noise component $\hat{N}_2(m, f)$ to the adaptation factor $\gamma(m)$. More specifically, piecewise linear mapping 805 provides a mapping from the difference in energy (or moving average of the difference in energy) between a current frame of the primary input speech signal P(m, f) and a current frame of the "cleaner" background noise component $\hat{N}_2(m, f)$ to the fast adaptation factor $\gamma_{fast}(m)$. Piecewise linear mapping 810, on the other hand, provides a mapping from the difference in energy (or moving average of the difference in energy) between a current frame of the primary input speech signal P(m, f) and a current frame of the "cleaner" background noise component $\hat{N}_2(m, f)$ to the slow adaptation factor $\gamma_{slow}(m)$.

In general, both mappings set the adaptation factor $\gamma(m)$ to a large value (e.g., a value of one) if the difference in energy (or moving average of the difference in energy) between a current frame of the primary input speech signal P(m, f) and a current frame of the "cleaner" background noise component $\hat{N}_2(m, f)$ is greater than a certain, predetermined value (indicating a strong likelihood of desired speech dominating background noise), and to a smaller value greater than zero and smaller than one if the difference in energy (or moving average of the difference in energy) between the current frame of the primary input speech signal P(m, f) and the current frame of the "cleaner" background noise component $\hat{N}_2(m, f)$ is less than a certain, predetermined value (indicating a strong likelihood of background noise dominating desired speech), while a piecewise linear mapping can be used in-between the two predetermined values.

Using a mapping as described above, generally means that the statistics expressed in Eq. (63), Eq. (64), Eq. (65), and Eq. (66) will be updated at a rate inversely related to the difference in energy (or moving, average of the difference in energy) between the primary input speech signal P(m, f) and the "cleaner" background noise component $\hat{N}_2(m, f)$.

Prior to applying adaptive noise canceler filter 325, one of the two sets of statistics needs to be selected for calculating its transfer function. In at least one embodiment, the set of statistics (i.e., either the fast or slow version) that results in adaptive noise canceler filter 325 producing an output signal with the least amount of power is selected. The output power of adaptive noise canceler filter 325 using each set of statistics can be expressed as:

$$E_{fast} = \sum_f \left|P(m, f) - W^{fast}(f)\hat{N}_2(m, f)\right|^2 \tag{67}$$

$$E_{slow} = \sum_f \left|P(m, f) - W^{slow}(f)\hat{N}_2(m, f)\right|^2 \tag{68}$$

where $$W^{fast}(f) = \frac{C^{fast}_{P,\hat{N}_2^*}(f)}{C^{fast}_{\hat{N}_2,\hat{N}_2^*}(f)} \tag{69}$$

$$W^{slow}(f) = \frac{CP^{slow}_{P,\hat{N}_2^*}(f)}{C^{slow}_{\hat{N}_2,\hat{N}_2^*}(f)} \tag{70}$$

Hence, the final adaptive noise canceler filter 325 is selected according to:

$$W(f) = \begin{cases} W^{fast}(f) & E_{fast} < E_{slow} \\ W^{slow}(f) & \text{otherwise} \end{cases} \tag{71}$$

FIG. 9 depicts a flowchart 900 of a method for estimating the time-varying statistics of adaptive noise canceler filter 325, illustrated in FIG. 3, in accordance with an embodiment of the present invention. The method of flowchart 900 can be performed, for example and without limitation, by statistics estimator 345 as described above in reference to FIG. 3. However, the method is not limited to that implementation.

As shown in FIG. 9, the method of flowchart 900 begins at step 905 and immediately transitions to step 910. At step 910, a current frame of the primary input speech signal P(m, f) and the "cleaner" background noise component $\hat{N}_2(m, f)$ are received.

At step 915, a difference in energy between the current frame of the primary input speech signal P(m, f) and the "cleaner" background noise component $\hat{N}_2(m, f)$ is calculated. Alternatively, a moving average of the difference in energy between the primary input speech signal P(m, f) and the "cleaner" background noise component $\hat{N}_2(m, f)$ is updated based on the current frame of each signal.

At step 920, the adaptation factors $\gamma_{slow}(m)$ and $\gamma_{fast}(m)$ are determined based on at least the difference in energy between the current frames of the primary input speech signal P(m, f) and the reference input speech signal R(m, f) calculated at step 915. For example, the adaptation factor $\gamma_{slow}(m)$ and $\gamma_{fast}(m)$ can be respectively determined based on piecewise linear mappings 805 and 810 illustrated in FIG. 8, although other mappings can be used to determine the adaptation factors. Alternatively, the adaptation factors $\gamma_{slow}(m)$ and $\gamma_{fast}(m)$ are determined based on at least the moving average of the difference in energy between the primary input speech signal. P(m, f) and the "cleaner" background noise component $\hat{N}_2(m, f)$. It should be noted that information other than the difference in energy calculated at step 915 or the moving average of the difference in energy can be used to determine the adaptation factors $\gamma_{slow}(m)$ and $\gamma_{fast}(m)$. For example, a voice activity indicator provided by a voice activity detector (not shown) can be used in combination with either the difference in energy calculated at step 915 or the moving average of the difference in energy to determine the adaptation factors $\gamma_{slow}(m)$ and $\gamma_{fast}(m)$.

At step 925, the statistics used to determine adaptive noise canceler filter 325 are updated based on the previous values of the statistics, the current frame of the primary input speech signal P(m, f) and the "cleaner" background noise component $\hat{N}_2(m, f)$, and the adaptation factors $\gamma_{slow}(m)$ and $\gamma_{fast}(m)$. For example, the statistics can be updated according to Eq. (63), Eq. (64), Eq. (65), and Eq. (66) above.

3.3 Automatic Microphone Calibration

Automatic microphone calibration can be further included in multi-channel noise suppression system 300 illustrated in FIG. 3 to estimate, for example, variations in the sensitivity of primary speech microphone 104 and noise reference microphone 106. This is an important function since the sensitivity of the microphones can vary, for example, by as much as ±3 dB, resulting in a maximum variation of ±6 dB. Such a large variation can undermine the effectiveness of using the difference in energy between the primary input speech signal P(m, f) and the reference input speech signal R(m, f) to determine the adaptation factors and time-varying statistics as discussed above in the preceding sub-sections. In performing automatic microphone calibration, it is important to only capture differences in the sensitivity of primary speech microphone 104 and noise reference microphone 106 due to production variations and/or aging, and not due to other factors, such as the direction or distance of a background noise source, shielding of one or both microphones (e.g., by a finger or hair), etc.

FIG. 10 illustrates an exemplary variation 1000 of multi-channel noise suppression system 300 that further implements an automatic microphone calibration scheme in accordance with an embodiment of the present invention. More specifically, multi-channel noise suppression system 1000 further includes a microphone mismatch estimator 1005 for estimating a difference in sensitivity between primary speech microphone 104 and noise reference microphone 106, and a microphone mismatch compensator 1010 to compensate for this estimated difference.

More specifically, microphone mismatch estimator 1005 determines and updates a current estimate of the difference in sensitivity between primary speech microphone 104 and noise reference microphone 106 by exploiting the knowledge that in diffuse sound fields (or when the device is far-field relative to a source) the energy of the signals received by primary speech microphone 104 and noise reference microphone 106 should be approximately equal, as well as the fact that aging of the two microphones is a slow process. Therefore, determining when the two microphones are in a diffuse sound field should provide a robust method for updating a current estimate of the difference in sensitivity between the two microphones. The identification of a diffuse sound field can be carried out in several different ways.

For example, one potential method for determining if the two microphones are in a diffuse sound field is to fix the phase according to a specific direction, calculate the corresponding optimal gain for maximum prediction of the signal received by noise reference microphone 106 from the signal received by primary speech microphone 104, and measure the prediction gain. By carrying these steps out for a variety of phases corresponding to a variety of directions, and comparing the prediction gains in different directions, it is possible to determine if sound is coming from multiple directions (indicating a diffuse sound field) or from a well-defined direction.

An alternative or supporting method is to assume diffuse noise when the energy of the signals received by both microphones are within some range of their respective minimum levels (representing the acoustic noise floor on each microphone). The lowest level is generally a result of diffuse environmental ambient noise (as long as it is above the noise floor of non-acoustic noise sources), and hence suitable for updating a current estimate of the difference in sensitivity between primary speech microphone 104 and noise reference microphone 106.

Additionally, updating of the sensitivity mismatch generally should be avoided when circuit noise, such as thermal noise, dominates. Such noise is picked up after the microphones, electronically rather than acoustically, and consequently is not reflective of the sensitivity of the microphones. Because thermal noise is generally incoherent between the signal paths of the two microphones, it can be mistaken for a diffuse sound field suitable for tracking the sensitivity mismatch. To prevent updating when such noise dominates, an absolute lower level can be established under which no updating or tracking is performed. Other non-acoustic noise sources that should be omitted for tracking of the microphone sensitivity mismatch include wind noise.

Moreover, the expected range of microphone sensitivity mismatch can generally be determined from specifications provided by the microphone manufacturer. Therefore, as a safeguard from divergence of the sensitivity mismatch estimation, the sensitivity mismatch can be updated only if the observed mismatch (without sensitivity mismatch compensation) is below the sum of the microphone production tolerances plus a suitable bias term. The bias term can be used to make sure the estimated microphone sensitivity mismatch can span the entire variation.

After determining a suitable time to update the sensitivity mismatch using, for example, one or more of the methods discussed above, microphone mismatch estimator 1005 actually updates the current estimated value of the sensitivity mismatch. Microphone mismatch estimator 1005 can update the current estimated value of the sensitivity mismatch based on the difference in energy between a current frame of the primary input speech signal P(m, f) and a current frame of the reference input speech signal R(m, f) during the suitable time. For example, microphone mismatch estimator can update the current estimated value of the sensitivity mismatch based on the difference in energy between the current frame of the primary input speech signal P(m, f) and the current frame of the reference input speech signal R(m, f) during the suitable time in accordance with the following moving average expression:

$$M^{cal}(m)=\beta_{cal}\cdot M^{cal}(m-1)+(1-\beta_{cal})\cdot M_{diff}(m) \quad (72)$$

where $M^{cal}(m)$ is the current estimated value of the acoustic sensitivity mismatch, $M^{cal}(m-1)$ is the previous estimated value of the acoustic sensitivity mismatch, $M_{diff}(m)$ is the difference in energy between the current frame of the primary input speech signal P(m, f) and the current frame of the reference input speech signal R(m, f) calculated during the suitable time, and $\beta_{cal}$ is a smoothing factor. The difference in energy can be calculated by subtracting the log-energy of the current frame of the reference input speech signal from the log-energy of the current frame of the primary input speech signal in at least one example.

In general, the objective of automatic microphone calibration is to track long term changes and variation in acoustic sensitivity. Therefore, a value close to (but smaller than) one for the smoothing factor $\beta_{cal}$ can be used to introduce long term averaging. However, a value close to one will also result in slow initial convergence and it may be advantageous to vary the smoothing factor $\beta_{cal}$ such that it has a smaller value immediately following a reset of the current estimated value of the sensitivity mismatch $M^{cal}(m)$ and gradually increasing it to a value close to one as updates are performed.

The current estimated value of the sensitivity mismatch $M^{cal}(m)$ is passed on to microphone mismatch compensator 1010 and is used by microphone mismatch compensator 1010 to scale reference input speech signal R(m, f) to compensate for any mismatch. The scaled version of reference input speech signal R(m, f) is denoted in FIG. 10 by the signal $\hat{R}(m, f)$. It should be noted, however, that the reference input speech signal R(m, f) is chosen to be scaled in multi-channel noise suppression system 1000 for illustrative purposes only and is not intended to be limiting. Persons skilled in the relevant art(s) will recognize that the primary input speech signal P(m, f) can be scaled to compensate for the estimated difference, or both the primary input speech signal P(m, f) and the reference input speech signal R(m, f) can be scaled to compensate for the estimated difference.

In another embodiment, rather than scaling the primary input speech signal P(m, f) and/or the reference input speech signal R(m, f) based the current estimated value of the sensitivity mismatch $M^{cal}(m)$, the current estimated value of the sensitivity mismatch $M^{cal}(m)$ can be used as an additional input to control the update of the time-varying statistics as described above in the preceding sub-sections.

FIG. 11 depicts a flowchart 1100 of a method for updating the current estimated value of the sensitivity mismatch in accordance with an embodiment of the present invention. The method of flowchart 1100 can be performed, for example and without limitation, by microphone mismatch estimator 1005 as described above in reference to FIG. 10. However, the method is not limited to that implementation.

As shown in FIG. 11, the method of flowchart 1100 begins at step 1105 and immediately transitions to step 1110. At step 1110, a current frame of the primary input speech signal P(m, f) and the reference input speech signal R(m, f) are received.

At step 1115, the presence of a diffuse sound field is identified (at least in part) based on the current frame of the primary input speech signal P(m, f) and the reference input speech signal R(m, f) using, for example, one or more of the methods described above in regard to FIG. 10.

At step 1120, a difference in energy between the current frame of the primary input speech signal P(m, f) and the reference input speech signal R(m, f) is calculated.

At step 1125, if the presence of a diffuse sound field is identified at step 1115, the current estimated value of the sensitivity mismatch is updated based on the previous estimated value of the sensitivity mismatch and the calculated difference in energy determined at step 1120. For example, the current estimated value of the sensitivity mismatch can be updated according to Eq. (72) above.

Instead of carrying out microphone mismatch estimation and compensation as detailed above, it is possible to instead track the (diffuse) noise levels on the two microphones, and then instead of using the level difference on the two microphones to control the estimation of statistics, use the level difference on the two microphones normalized by their respective (diffuse) noise levels to control the estimation of statistics. This would result in the use of the SNR difference on the two microphones instead of the level difference being used to control the estimation of statistics. Hence, wherever level difference is referred as an input for means of controlling update of statistics, it should be understood that a corresponding SNR difference can be used as an alternative, thereby effectively carrying out microphone mismatch compensation implicitly.

4. Variations

4.1 Frequency Dependent Adaptation Factor

As can be seen in section 3 above, the estimation of the time-varying statistics used to derive (or update) blocking matrix filter 315 and adaptive noise canceler filter 325 can be controlled by the full-band energy difference of various signals (e.g., the full-band energy difference of primary input speech signal P(m, f) and reference input speech signal R(m, f)). However, improved performance can be expected by allowing the update control of the time-varying statistics to have some frequency resolution.

For example, the update control can be based on frequency dependent energy differences. More specifically, the adaptation factors (which are used as an update control) can become frequency dependent according to the mapping from the frequency dependent energy differences to adaptation factors. The advantage of this can be seen intuitively from a simple example. Assume that desired speech only has content below 1500 Hz and background noise only has content above 2000 Hz. With the full-band energy difference, the algorithm will try to come up with a full-band likelihood of desired speech presence. This likelihood will depend on the relative energies of the desired speech and background noise. On the other hand, if frequency dependent update control is implemented, then updates can be done with likelihood of desired signal presence being one below 1500 Hz and zero above 2000 Hz, and both speech statistics for blocking matrix filter 315 and noise statistics for adaptive noise canceler filter 325 can be updated more optimally.

4.2 Switched Blocking Matrix and Adaptive Noise Canceler

When desired speech is absent in the primary input speech signal P(m, f), the speech statistics for blocking matrix filter 315 generally are not updated and the filter remains unchanged. This means that the "cleaner" background noise component $\hat{N}_2(m, f)$, produced (in part) by blocking matrix filter 315, during desired speech absence will not only include the background noise component $N_2(m, f)$ of the reference input speech signal R(m, f), but also an additive filtered component of the primary input speech signal P(m, f), which contains only background noise and no desired speech. This additive filtered component can effectively complicate the task of adaptive noise canceler filter 325 to the point of the filter providing significantly reduced noise suppression compared to disabling blocking matrix filter 315 during desired speech absence. Therefore, it can be advantageous to operate a switched structure, where blocking matrix filter 315 can be disabled during desired speech absence.

To accommodate such a switched structure, multiple copies of the time-varying statistics used to derive (or update) adaptive noise canceler filter 325 can be maintained. More specifically, one copy of the time-varying statistics used to derive (or update) adaptive noise canceler filter 325 can be maintained for use when blocking matrix filter 315 is enabled and another copy of the time-varying statistics used to derive (or update) adaptive noise canceler filter 325 can be maintained for use when blocking matrix filter 315 is disabled.

4.2.1 Scaled Blocking Matrix

In practice it may be advantageous to use a switching mechanism to turn blocking matrix filter 315 partially on and partially off based on the likelihood of speech being present in the primary input speech signal P(m, f), rather than using a hard switching mechanism that simply turns blocking matrix filter 315 either completely on or completely off. For example, such a soft switching mechanism can be implemented as a scaling of the coefficients of blocking matrix filter 315 with a scaling factor having a value between zero and one that can be adjusted based on the likelihood of desired speech being present in the primary input speech signal P(m, f). A good estimate of the likelihood of desired speech being present in the primary input speech signal P(m, f) can be calculated from the difference in energy between the primary input speech signal P(m, f) and the reference input speech signal R(m, f).

Furthermore, it can be advantageous to make the scaling factor frequency dependent, as the desired speech source may occupy/dominate certain frequency range(s) while a background noise source may occupy/dominate a different frequency range(s). Frequency dependency can be achieved by not calculating the difference in energy between the primary input speech signal P(m, f) and the reference input speech signal R(m, f) on a full-band basis, but rather based on individual frequency bins, or groups of frequency bins.

The frequency dependent level difference can be calculated as:

$$M_{frq}(m,f)=\beta_{r_1}\cdot M_{frq}(m-1,f)+(1+\beta_{r_1})\cdot(10\cdot\log_{10}(P(m,f)P^*(m,f))-10\cdot\log_{10}(R(m,f)R^*(m,f))) \quad (73)$$

where P(m, f) and R(m, f) have already been subject to the microphone mismatch compensation. The scaled taps of blocking matrix filter 315 are calculated according to:

$$H(m, f) = \begin{cases} 0 & M_{frq}(m, f) < T_{off} \\ \dfrac{M_{frq}(m, f) - T_{off}}{T_{on} - T_{off}} \cdot \dfrac{C_{R,P^*}(m, f)}{C_{P,P^*}(m, f)} & T_{off} \le M_{frq}(m, f) \le T_{on} \\ \dfrac{C_{R,P^*}(m, f)}{C_{P,P^*}(m, f)} & M_{frq}(m, f) > T_{on} \end{cases} \quad (74)$$

Hence, it equals the regular blocking matrix filter 315 during certain desired speech presence (large microphone level difference at the specific frequency bin), is completely off during certain desired speech absence, and assumes a scaled version according to the microphone level difference at the specific frequency bin during uncertainty of desired speech presence. Example values of the parameters are $T_{off}$=3 dB and $T_{off}$=8 dB.

4.2.2 Adaptive Noise Canceler as a Function of the Blocking Matrix

A complication of having soft-decision in form of the blocking matrix scaling rather than a hard on-off switch is the inability to simply maintaining two sets of statistics for the ANC section (one corresponding to the blocking matrix on, and a second to the blocking matrix off). The scaling of the blocking matrix will introduce a source of modulation into the output signal of the blocking matrix, on which the statistics for the ANC section are based, which could further complicate the tracking of the ANC statistics. To address that, the solution for the ANC section is further analyzed. The analysis is based on the single complex tap, but can be applied to any of the formulations. From sub-section 2.2:

$$\begin{aligned} C_{P,\hat{N}_2^*}(f) &= \sum_m P(m,f)\hat{N}_2^*(m,f) \\ &= \sum_m P(m,f)(R(m,f)-H(f)P(m,f))^* \\ &= \sum_m P(m,f)R^*(m,f) - H(f)\sum_m p(m,f)P^*(m,f) \\ &= C_{P,R^*}(f) - H(f)C_{P,P^*}(f) \end{aligned} \tag{75}$$

$$\begin{aligned} C_{\hat{N}_2,\hat{N}_2^*}(f) &= \sum_m \hat{N}_2(m,f)\hat{N}_2^*(m,f) \\ &= \sum_m (R(m,f)-H(f)P(m,f)) \\ &\quad (R(m,f)-H(f)P(m,f))^* \\ &= \sum_m R(m,f)R^*(m,f) + \\ &\quad H(f)H^*(f)\sum_m P(m,f)P^*(m,f) - \\ &\quad 2\mathrm{Re}\left\{H(f)\sum_m P(m,f)R^*(m,f)\right\} \\ &= C_{R,R^*}(f) + H(f)H^*(f)C_{P,P^*}(f) - \\ &\quad 2\mathrm{Re}\{H(f)C_{P,R^*}(f)\} \end{aligned} \tag{76}$$

As opposed to sub-section 3.2 above, where the noise components of $C_{P,\hat{N}_2^*}(f)$ and $C_{\hat{N}_2,\hat{N}_2^*}(f)$ were tracked and estimated, the present solution requires tracking of the noise components of $C_{P,R^*}(f)$, $C_{P,P^*}(f)$, and $C_{R,R^*}(f)$. From these estimates and the instantaneous (scaled) blocking matrix filter 315, the estimates of $C_{P,\hat{N}_2^*}(f)$ and $C_{\hat{N}_2,\hat{N}_2^*}(f)$ can be calculated according to the above two equations, providing the necessary statistics to calculate the filter taps of adaptive noise canceler filter 325 according to sub-section 3.2. The necessary estimates of the statistics, $C_{P,R^*}(f)$, $C_{P,P^*}(f)$, and $C_{R,R^*}(f)$, are calculated equivalently to the estimates of the statistics of $C_{P,\hat{N}_2^*}(f)$ and $C_{\hat{N}_2,\hat{N}_2^*}(f)$ in sub-section 3.2 and both a fast tracking and a slow tracking version of these statistics can be used:

$$C_{P,R^*}^{fast}(m,f)=\gamma_{fast}(m,f)\cdot C_{P,P^*}^{fast}(m-1,f)+(1-\gamma_{fast}(m,f))\cdot P(m,f)R^*(m,f) \tag{77}$$

$$C_{P,P^*}^{fast}(m,f)=\gamma_{fast}(m,f)\cdot C_{P,P^*}^{fast}(m-1,f)+(1-\gamma_{fast}(m,f))\cdot P(m,f)P^*(m,f) \tag{79}$$

and $$C_{P,R^*}^{slow}(m,f)=\gamma_{slow}(m,f)\cdot C_{P,R^*}^{slow}(m-1,f)+(1-\gamma_{slow}(m,f))\cdot P(m,f)P^*(m,f) \tag{80}$$

$$C_{P,P^*}^{slow}(m,f)=\gamma_{slow}(m,f)\cdot C_{P,P^*}^{slow}(m-1,f)+(1-\gamma_{slow}(m,f))\cdot P(m,f)P^*(m,f) \tag{81}$$

$$C_{R,R^*}^{slow}(m,f)=\gamma_{slow}(m,f)\cdot C_{R,R^*}^{slow}(m-1,f)+(1-\gamma_{slow}(m,f))\cdot R(m,f)R^*(m,f) \tag{82}$$

Additionally, as indicated by the above equations the fast and slow adaptation factors $\gamma_{fast}(m)$ and $\gamma_{slow}(m)$ can be made frequency dependent by mapping the level difference on a frequency bin basis. The mapping can be identical to that of section 3.2, except for being frequency bin based instead of full-band based.

Yet a further refinement is to select taps from the fast and slow tracking ANCs on a frequency bin basis instead of a fall-band basis as in section 3.2:

$$E_{fast}(m,f)=|P(m,f)-W^{fast}(f)\hat{N}_2(m,f)|^2 \tag{83}$$

$$E_{slow}(m,f)=|P(m,f)-W^{slow}(f)\hat{N}_2(m,f)|^2 \tag{84}$$

where:

$$W^{fast}(m,f)=\frac{C_{P,R^*}^{fast}(m,f)-H(f)C_{P,P^*}^{fast}(m,f)}{C_{R,R^*}^{fast}(m,f)+H(f)H^*(f)C_{P,P^*}^{fast}(m,f)-2\mathrm{Re}\{H(f)C_{P,R^*}^{fast}(m,f)\}} \tag{85}$$

$$W^{slow}(m,f)=\frac{C_{P,R^*}^{slow}(m,f)-H(f)C_{P,P^*}^{slow}(m,f)}{C_{R,R^*}^{slow}(m,f)+H(f)H^*(f)C_{P,P^*}^{slow}(m,f)-2\mathrm{Re}\{H(f)C_{P,R^*}^{slow}(m,f)\}} \tag{86}$$

Hence, the final adaptive noise canceler filter 325 is selected according to:

$$W(m,f)=\begin{cases} W^{fast}(m,f) & E_{fast}(m,f)<E_{slow}(m,f) \\ W^{slow}(m,f) & \text{otherwise} \end{cases} \tag{87}$$

5. Example Computer System Implementation

It will be apparent to persons skilled in the relevant art(s) that various elements and features of the present invention, as described herein, can be implemented in hardware using analog and/or digital circuits, in software, through the execution of instructions by one or more general purpose or special-purpose processors, or as a combination of hardware and software.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 1200 is shown in FIG. 12. All of the modules depicted in FIGS. 3 and 8, and, for example, can execute on one or more distinct computer systems 1200. Furthermore, each of the steps of the flowcharts depicted in FIGS. 5, 7, 9, and 10 can be implemented on one or more distinct computer systems 1200.

Computer system 1200 includes one or more processors, such as processor 1204. Processor 1204 can be a special purpose or a general purpose digital signal processor. Processor 1204 is connected to a communication infrastructure 1202 (for example, a bus or network). Various software implementations are described in terms of this exemplary computer system. After reading this description, it will become apparent to a person skilled in the relevant art(s) how to implement the invention using other computer systems and/or computer architectures.

Computer system 1200 also includes a main memory 1206, preferably random access memory (RAM), and may also include a secondary memory 1208. Secondary memory 1208 may include, for example, a hard disk drive 1210 and/or a removable storage drive 1212, representing a floppy disk drive, a magnetic tape drive, an optical disk drive, or the like. Removable storage drive 1212 reads from and/or writes to a removable storage unit 1216 in a well-known manner. Removable storage unit 1216 represents a floppy disk, magnetic tape, optical disk, or the like, which is read by and written to by removable storage drive 1212. As will be appreciated by persons skilled in the relevant art(s), removable storage unit 1216 includes a computer usable storage medium having stored therein computer software and/or data.

In alternative implementations, secondary memory 1208 may include other similar means for allowing computer programs or other instructions to be loaded into computer system 1200. Such means may include, for example, a removable storage unit 1218 and an interface 1214. Examples of such means may include a program cartridge and cartridge interface (such as that found in video game devices), a removable memory chip (such as an EPROM, or PROM) and associated socket, a thumb drive and USB port, and other removable storage units 1218 and interfaces 1214 which allow software and data to be transferred from removable storage unit 1218 to computer system 1200.

Computer system 1200 may also include a communications interface 1220. Communications interface 1220 allows software and data to be transferred between computer system 1200 and external devices. Examples of communications interface 1220 may include a modem, a network interface (such as an Ethernet card), a communications port, a PCMCIA slot and card, etc. Software and data transferred via communications interface 1220 are in the form of signals which may be electronic, electromagnetic, optical, or other signals capable of being received by communications interface 1220. These signals are provided to communications interface 1220 via a communications path 1222. Communications path 1222 carries signals and may be implemented using wire or cable, fiber optics, a phone line, a cellular phone link, an RF link and other communications channels.

As used herein, the terms "computer program medium" and "computer readable medium" are used to generally refer to tangible storage media such as removable storage units 1216 and 1218 or a hard disk installed in hard disk drive 1210. These computer program products are means for providing software to computer system 1200.

Computer programs (also called computer control logic) are stored in main memory 1206 and/or secondary memory 1208. Computer programs may also be received via communications interface 1220. Such computer programs, when executed, enable the computer system 1200 to implement the present invention as discussed herein. In particular, the computer programs, when executed, enable processor 1204 to implement the processes of the present invention, such as any of the methods described herein. Accordingly, such computer programs represent controllers of the computer system 1200. Where the invention is implemented using software, the software may be stored in a computer program product and loaded into computer system 1200 using removable storage drive 1212, interface 1214, or communications interface 1220.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

6. Conclusion

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

In addition, while various embodiments have been described above, it should be understood that they have been presented by way of example only, and not limitation. It will be understood by those skilled in the relevant art(s) that various changes in form and details can be made to the embodiments described herein: without departing from the spirit and scope of the invention as defined in the appended claims. Accordingly, the breadth and scope of the present invention should not be limited by any of the above-described exemplary embodiments, but should be defined only in accordance with the following claims and their equivalents.

What is claimed is:

1. A system for suppressing noise in a primary input speech signal that comprises a first desired speech component and a first background noise component using a reference input speech signal that comprises a second desired speech component and a second background noise component, the system comprising:

a blocking matrix configured to filter the primary input speech signal, in accordance with a first transfer function, to estimate the second desired speech component and to remove the estimate of the second desired speech component from the reference input speech signal to provide an adjusted second background noise component;

an adaptive noise canceler configured to filter the adjusted second background noise component, in accordance with a second transfer function, to estimate the first background noise component and to remove the estimate of the first background noise component from the primary input speech signal to provide a noise suppressed primary input speech signal, wherein the first transfer function is determined based on statistics of the first desired speech component and the second desired speech component, and the second transfer function is determined based on statistics of the primary input speech signal and the adjusted second background noise component.

2. The system of claim 1, wherein the statistics of the first desired speech component and the second desired speech component comprise:

desired speech statistics of the primary input speech signal determined based on an estimate of a power spectrum of the first desired speech component, and desired speech cross-channel statistics determined based on an estimate of a cross-spectrum between the first desired speech component and the second desired speech component.

3. The system of claim 2, wherein the blocking matrix comprises a statistics estimator configured to:

estimate the power spectrum of the first desired speech component based on a product of a spectrum of the primary input speech signal and a complex conjugate of the spectrum of the primary input speech signal, and update the desired speech statistics of the primary input speech signal with the product of the spectrum of the primary input speech signal and the complex conjugate of the spectrum of the primary input speech signal at a rate related to a difference in energy or level between the primary input speech signal and the reference input speech signal.

4. The system of claim 2, wherein the blocking matrix comprises a statistics estimator configured to:

estimate the cross-spectrum between the first desired speech component and the second desired speech component based on a spectrum of the reference input speech signal and the spectrum of the primary input speech signal, and update the desired speech cross-channel statistics based on the spectrum of the reference input speech signal and the spectrum of the primary input speech signal at a rate related to a difference in energy or level between the primary input speech signal and the reference input speech signal.

5. The system of claim 1, wherein the first transfer function is further determined based on statistics of the first background noise component and the second background noise component.

6. The system of claim 5, wherein the statistics of the first background noise component and the second background noise component comprise:

stationary background noise statistics of the primary input speech signal determined based on a spectrum of the primary input speech signal, and stationary background noise cross-channel statistics determined based on a spectrum of the primary input speech signal and a spectrum of the reference input speech signal.

7. The system of claim 6, wherein the blocking matrix comprises a statistics estimator configured to:

update the stationary background noise statistics of the primary input speech signal with the product of the spectrum of the primary input speech signal and the complex conjugate of the spectrum of the primary input speech signal at a rate related to a difference in energy or level between the primary input speech signal and the reference input speech signal.

8. The system of claim 6, wherein the blocking matrix comprises a statistics estimator configured to:

update the stationary background noise cross-channel statistics based on the spectrum of the primary input speech signal and the spectrum of the reference input speech signal at a rate related to a difference in energy or level between the primary input speech signal and the reference input speech signal.

9. The system of claim 1, wherein the statistics of the primary input speech signal and the adjusted second background noise component comprise:

background noise statistics determined based on a product of a spectrum of the adjusted second background noise component and a complex conjugate of the spectrum of the adjusted second background noise component, and cross-channel background noise statistics determined based on a spectrum of the primary input speech signal and the spectrum of the adjusted second background noise component.

10. The system of claim 9, wherein the adaptive noise canceler comprises a statistics estimator configured to:

update the background noise statistics with the product of the spectrum of the adjusted second background noise component and the complex conjugate of the spectrum of the adjusted second background noise component at a rate related to a difference in energy or level between the primary input speech signal and the adjusted second background noise component.

11. The system of claim 9, wherein the adaptive noise canceler comprises a statistics estimator configured to:

update the cross-channel background noise statistics based on the spectrum of the primary input speech signal and the spectrum of the adjusted second background noise component at a rate related to a difference in energy or level between the primary input speech signal and the adjusted second background noise component.

12. The system of claim 9, wherein the adaptive noise canceler comprises a statistics estimator configured to:

update a fast version of the background noise statistics with the product of the spectrum of the adjusted second background noise component and the complex conjugate of the spectrum of the adjusted second background noise component at a first rate related to a difference in energy or level between the primary input speech signal and the adjusted second background noise component, update a slow version of the background noise statistics with the product of the spectrum of the adjusted second background noise component and the complex conjugate of the spectrum of the adjusted second background noise component at a second rate different from the first rate and related to a difference in energy or level between the primary input speech signal and the adjusted second background noise component, and select between the fast version of the background noise statistics and the slow version of the background noise statistics to determine the second transfer function based on which background noise statistics result in the noise suppressed primary input speech signal having a smaller energy.

13. The system of claim 9, wherein the adaptive noise canceler comprises a statistics estimator configured to:

update a fast version of the cross-channel background noise statistics based on the spectrum of the primary input speech signal and the spectrum of the adjusted second background noise component at a first rate related to a difference in energy or level between the primary input speech signal and the adjusted second background noise component, update a slow version of the cross-channel background noise statistics based on the spectrum of the primary input speech component and the spectrum of the adjusted second background noise component at a second rate different from the first rate and related to a difference in energy or level between the primary input speech signal and the adjusted second background noise component, and select between the fast version of the cross-channel background noise statistics and the slow version of the cross-channel background noise statistics to determine the second transfer function based on which cross-channel background noise statistics result in the noise suppressed primary input speech signal having a smaller energy.

14. The system of claim 1, wherein the blocking matrix receives and processes the primary input speech signal in the frequency domain.

15. The system of claim 1, wherein the blocking matrix receives and processes the primary input speech signal in the frequency domain using a plurality of time direction filters, each of the plurality of time direction filters configured to filter a different sub-band or frequency component of the primary input speech signal.

16. The system of claim 1, wherein the adaptive noise canceler receives and processes the adjusted second background noise component in the frequency domain.

17. The system of claim 1, wherein the adaptive noise canceler receives and processes the adjusted second background noise signal in the frequency domain using a plurality of time direction filters, each of the plurality of time direction filters configured to filter a different sub-band or frequency component of the adjusted second background noise component.

18. The system of claim 1, further comprising:

a microphone mismatch estimator configured to estimate a difference in microphone sensitivity between a first microphone that receives the primary input speech signal and a second microphone that receives the reference input speech signal.

19. The system of claim 18, wherein the microphone mismatch estimator is further configured to identify a presence of a diffuse sound field at least in part based on the primary input speech signal and the reference input speech signal and update the estimated difference in microphone sensitivity when the presence of the diffuse sound field is identified.

20. A method for suppressing noise in a primary signal that comprises a first desired speech signal and a first noise signal using a reference signal that comprises a second desired speech signal and a second noise signal, the method comprising:

filtering the primary input speech signal in accordance with a first transfer function to estimate the second desired speech signal;

removing the estimate of the second desired speech signal from the reference signal to provide an adjusted second noise signal;

filtering the adjusted second noise signal, in accordance with a second transfer function, to estimate the first noise signal;

removing the estimate of the first noise signal from the primary signal to provide a noise suppressed primary signal;

determining the first transfer function based on statistics of the first desired speech signal and the second desired speech signal; and determining the second transfer function based on statistics of the primary signal and the adjusted second noise signal.

* * * * *

UNITED STATES PATENT AND TRADEMARK OFFICE

CERTIFICATE OF CORRECTION

PATENT NO. : 8,965,757 B2
APPLICATION NO. : 13/295818
DATED : February 24, 2015
INVENTOR(S) : Thyssen et al.

It is certified that error appears in the above-identified patent and that said Letters Patent is hereby corrected as shown below:

In the Specification

Column 11, Line 3 (Item 15)

Please replace " $\underline{R}_P(f)$ " with -- $\underline{\underline{R}}_P(f)$ --.

Column 11, Line 7 (Item 16)

Please replace " $\underline{R}_P(f)$ " with -- $\underline{\underline{R}}_P(f)$ --.

Column 11, Line 23 (Item 19)

Please replace " $(\underline{R}_P(f))^{-}$ " with -- $(\underline{\underline{R}}_P(f))^{-1}$ --.

Column 13, Line 33 (Item 24)

Please replace " $(\underline{R}_P(f))^{-1}$ " with -- $(\underline{\underline{R}}_P(f))^{-1}$ --.

Column 17, Line 56 (Item 38)

Please replace " $\underline{R}_{\hat{N}_2}(f)$ " with -- $\underline{\underline{R}}_{\hat{N}_2}(f)$ --.

Column 18, Line 14 (Item 42)

Please replace " $(\underline{R}_{\hat{N}_2}(f))^{-1}$ " with -- $(\underline{\underline{R}}_{\hat{N}_2}(f))^{-1}$ --.

Column 19, Line 68 (Item 45)

Please replace " $\underline{R}_{\hat{N}_2}(f)$ " with -- $\underline{\underline{R}}_{\hat{N}_2}(f)$ --.

Signed and Sealed this
Fifteenth Day of September, 2015

Michelle K. Lee

Michelle K. Lee
*Director of the United States Patent and Trademark Office*

Column 20, Line 5 (Item 46)

Please replace "$\boldsymbol{r}_{..s_1,\dot{N}_2\cdot}(f)$" with -- $\underline{r}_{s_1,\dot{N}_2\cdot}(f)$ --.